US011382469B2

(12) United States Patent
Yang et al.

(10) Patent No.: US 11,382,469 B2
(45) Date of Patent: Jul. 12, 2022

(54) CLEANER

(71) Applicant: LG ELECTRONICS INC., Seoul (KR)

(72) Inventors: Ingyu Yang, Seoul (KR); Kietak Hyun, Seoul (KR); Jinhyouk Shin, Seoul (KR); Soohan Eo, Seoul (KR); Daeho Chang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 135 days.

(21) Appl. No.: 16/990,755

(22) Filed: Aug. 11, 2020

(65) Prior Publication Data

US 2020/0383543 A1 Dec. 10, 2020

Related U.S. Application Data

(63) Continuation of application No. 16/893,215, filed on Jun. 4, 2020.

(30) Foreign Application Priority Data

Jun. 5, 2019 (KR) ..... 10-2019-0066843
Jul. 1, 2019 (KR) ..... 10-2019-0078898
(Continued)

(51) Int. Cl.
*A47L 9/10* (2006.01)
*A47L 9/16* (2006.01)
(Continued)

(52) U.S. Cl.
CPC ..... *A47L 9/108* (2013.01); *A47L 9/127* (2013.01); *A47L 9/1608* (2013.01); *A47L 9/1683* (2013.01); *A47L 9/20* (2013.01)

(58) Field of Classification Search
CPC ..... A47L 9/108; A47L 9/127; A47L 9/1608; A47L 9/1683; A47L 9/20
See application file for complete search history.

(56) References Cited

U.S. PATENT DOCUMENTS 6,625,845 B2 * 9/2003 Matsumoto ..... A47L 9/20 15/352
9,872,592 B2 1/2018 Kleine-Doepke et al.
(Continued)

FOREIGN PATENT DOCUMENTS

CN 101617929 A 1/2010
CN 105246385 A 1/2016
(Continued)

*Primary Examiner* — Andrew A Horton
(74) *Attorney, Agent, or Firm* — Dentons US LLP

(57) ABSTRACT

A cleaner includes a housing including a suction opening, a cyclone part configured to separate air and dust, and a dust bin configured to store dust separated from air in the cyclone part and a frame disposed to surround an axis of a cyclone flow of the cyclone part in the housing and configured to be movable between a first position and a second position in the housing, wherein the frame includes a first body disposed to face the suction opening at the first position and disposed to be inclined with respect to the axis of the cyclone flow, and an upper end of the first body is located to be the same as or higher than an upper end of the suction opening.

16 Claims, 24 Drawing Sheets

(30) Foreign Application Priority Data

Jan. 9, 2020 (KR) ..... 10-2020-0003103
Jan. 9, 2020 (KR) ..... 10-2020-0003105
Jan. 9, 2020 (KR) ..... 10-2020-0003106

(51) Int. Cl.
*A47L 9/20* (2006.01)
*A47L 9/12* (2006.01)

(56) References Cited

U.S. PATENT DOCUMENTS

| | | | |
|---|---|---|---|
| 9,943,202 | B2 | 4/2018 | Eo et al. |
| 10,398,272 | B2 | 9/2019 | Hyun et al. |
| 10,499,779 | B2 | 12/2019 | Muir et al. |
| 2017/0156559 | A1 | 6/2017 | Krebs et al. |
| 2018/0132685 | A1 | 5/2018 | Muir et al. |
| 2019/0183301 | A1 | 6/2019 | Hwang et al. |

FOREIGN PATENT DOCUMENTS

| | | | |
|---|---|---|---|
| CN | 108065862 | A | 5/2018 |
| EP | 3437534 | A1 | 2/2019 |
| JP | 2005-058787 | A | 3/2005 |
| KR | 10-2004-0025542 | A | 3/2004 |
| KR | 10-2016-0038570 | A | 4/2016 |
| KR | 10-2018-0023790 | A | 3/2018 |
| TW | 201200092 | A | 1/2012 |
| TW | 201735845 | A | 10/2017 |
| TW | I636759 | B | 10/2018 |

* cited by examiner

CLEANER

CROSS-REFERENCE TO RELATED APPLICATIONS

This application is a Continuation of U.S. patent application Ser. No. 16/893,215, filed on Jun. 4, 2020, which claims the benefit of the Korean Patent Application No. 10-2019-0066843 filed on Jun. 5, 2019, Korean Patent Application No. 10-2019-0078898 filed on Jul. 1, 2019, Korean Patent Application No. 10-2020-0003103 filed on Jan. 9, 2020, Korean Patent Application No. 10-2020-0003105 filed on Jan. 9, 2020, Korean Patent Application No. 10-2020-0003106 filed on Jan. 9, 2020, which are hereby incorporated by reference as if fully set forth herein.

BACKGROUND

Field

The present disclosure relates to a cleaner.

Related Art

A cleaner is a device that performs cleaning by suctioning or wiping dust or foreign substances located in a cleaning target area.

Such a cleaner may be classified as a manual cleaner which requires a user to directly move the cleaner, and an automatic cleaner that drives on its own and does not require a user to manually move the cleaner.

In addition, the manual cleaner may be classified as, e.g., a canister type cleaner, an upright type cleaner, a handy type cleaner, a stick type cleaner, etc.

For example, US Patent Publication No. US2018/0132685A1 discloses a compression mechanism having a dust compression part compressing dust in a dust bin.

The compression mechanism may include a dust bin having an opening, a filter purifying air in the dust bin, a shroud surrounding the filter, a dust compression part disposed to surround the shroud, a handle operated by a user to move the dust compression part, and a link connected to the handle.

When the dust compression part is lowered by an operation force of the handle transferred thereto through the link, the dust compression part compresses dust in the dust bin.

However, according to the related art document, at least a portion of the dust compression part is located higher than the opening at a standby position, and thus the dust compression part is accommodated in the dust bin without guiding a flow of air.

Therefore, an internal space of the dust bin is reduced by a thickness of the dust compression part, resulting in a reduction in the space for separating dust.

In addition, a lower surface of the dust compression part compresses the dust stored in the dust bin, and here, if the dust compression part is located higher than the opening, a distance for the dust compression part to vertically move for compressing the dust is reduced to result in a reduction in dust compression performance.

Because the dust compression part moves in contact with an inner circumferential surface of the dust bin, the inner circumferential surface of the dust bin may be cleaned, but there is a possibility that dust may be caught between the dust compression part and the inner circumferential surface of the dust bin, and in this case, a vertical movement of the dust compression part is not smooth.

In particular, when the dust compression part is lowered and rises in the process of suctioning air and dust through the opening, there is a problem that dust accumulates on an upper side of the dust compression part.

When the amount of dust accumulated on the upper side of the dust compression part is large, a vertical movement of the dust compression part is not smooth and the dust compression part may not be able to move to a standby position and block the opening.

SUMMARY

The present disclosure provides a cleaner in which air and dust suctioned through the suction opening fall into a dust bin even when a movable part is operated downward in a process of operating the cleaner.

The present disclosure provides a cleaner in which, even if dust is present on an upper side of a movable part in a lifted state after the movable part is moved to a lower side, the dust present on the upper side of the movable part may easily fall to the dust bin by air suctioned through the suction opening.

The present disclosure provides a cleaner in which air passing through a suction opening at a standby position of a movable part is prevented from directly moving to an air flow path.

To achieve these and other advantages and in accordance with the purpose of the disclosure, as embodied and broadly described herein, there is provided a cleaner including a housing including a suction opening, a cyclone part configured to separate dust from air introduced through the suction opening, and a dust bin configured to store the dust separated at the cyclone part; and a movable part configured to be movable between a first position and a second position in the housing.

The movable part may include a frame disposed to surround an axis of a cyclone flow of the cyclone part at the first position. The frame may include an air flow path through which air flows so that dust accumulated in the frame falls from the movable part in the process of moving to the second position or returning from the second position to the first position.

In one embodiment, the frame may include a first body facing the suction opening at the first position and inclined at a first angle with respect to a horizontal plane and a second body extending from the first body and inclined at a second angle smaller than the first angle with respect to the horizontal plane. The second body may form the air flow path through which air introduced through the suction opening flows.

A bottom surface of the second body may define a lower portion of the air flow path. The bottom surface of the second body may be lowered in a circumferential direction. Dust in the air flow path may flow downward, while flowing in the circumferential direction.

A height of the air flow path may increase in a direction away from the first body, so that a width through which dust flows is secured so that dust may easily flow through the air flow path.

The frame may further include an extension wall extending upward from an outer end of the second body to define the air flow path. The air flow path may spirally flow by the extension wall.

The frame may further include a third body extending in the circumferential direction from the second body and inclined at a third angle with respect to the horizontal plane.

The first body may be inclined to the outside upward from a lower side toward an upper side and the third body may be inclined to the outside downward from the upper side toward the lower side, so that dust may move downward along the third body.

The frame may further include a fourth body extending in the circumferential direction from the third body and inclined at a fourth angle with respect to the horizontal plane, wherein the fourth angle may be greater than the third angle.

A radius of an outer end of the fourth body based on the center of the frame may be smaller than a radius of an outer end of the first body.

A distance between the fourth body and an inner circumferential surface of the housing is larger than a distance between the first body and the inner circumferential surface of the housing, and thus dust on the air flow path may fall downward through a space between the fourth body and the inner circumferential surface of the housing.

Alternatively, the frame may include a third body extending from the second body so that air or dust flowing through the air flow path falls downward.

A distance between a point of the third body and the inner circumferential surface of the housing may be greater than a distance between the second body and the inner circumferential surface of the housing.

The frame may further include a fourth body extending from the third body, an inclination angle of the fourth body with respect to the horizontal plane may be greater than an inclination angle of the third body, and a distance between one point of the fourth body and the inner circumferential surface of the housing may be greater than the distance between the third body and the inner circumferential surface of the housing.

The cleaner may further include an air guide located in the housing, wherein the frame may be disposed to surround the air guide at the first position.

The air guide may include a guide wall disposed to surround the axis of the cyclone flow, the first body may be in contact with the guide wall, and at least a portion of the second body may be spaced apart from the guide wall and the air flow path may be located in a space between the guide wall and the second body.

The first body may be disposed to face the suction opening, so that air introduced through the suction opening may be prevented from flowing directly to the air flow path.

The cleaner may further include a filter part configured to filter dust from the air introduced through the suction opening in the housing.

The movable part may further include a cleaning part coupled to the frame and configured to clean the filter part when moving between the first position and the second position.

The frame body may further include a third body extending from the second body and a fourth body extending from the three body so that air or dust flowing through the air flow path may smoothly fall downward.

A distance between the fourth body and the inner circumferential surface of the housing may be greater than a distance between the third body and the inner circumferential surface of the housing.

With respect to the horizontal plane, the third body may be inclined at a third angle and the fourth body may be inclined at a fourth angle greater than the third angle.

In another embodiment of the present disclosure, there is provided a cleaner including a housing including a suction opening; a filter part configured to filter dust from air introduced through the suction opening and spaced apart from an inner circumferential surface of the housing; an air guide configured to guide the air passing through the filter part to a suction motor for generating a suction force; and a movable part configured to be movable between a first position and a second position in the housing.

The air guide may include a first guide wall spaced apart from the inner circumferential surface of the housing, and the movable part may include a frame disposed to surround at least a portion of the first guide wall at the first position.

The frame may include a first body in contact with the first guide wall and inclined at a first angle with respect to a horizontal plane and a second body extending in a circumferential direction from the first body and inclined at a second angle smaller than the first angle with respect to the horizontal plane.

The second body may be spaced apart from the first guide wall, and an air flow path may be provided between the first guide wall and the second body.

A height of the air flow path may increase in a direction away from the first body.

The cleaner may further include: an extension wall extending upward from an outer end of the second body. The extension wall may be spaced apart from the first guide wall.

The frame may further include a third body extending in a circumferential direction from the second body and inclined at a third angle with respect to the horizontal plane.

The first body may be inclined upward toward the outside from a lower side to an upper side, and the third body may be inclined downward toward the outside from the upper side to the lower side.

An inclination angle of the second body may be varied in the circumferential direction. The third angle may be greater than an inclination angle at a point of the second body.

The frame may further include a fourth body extending in a circumferential direction from the third body and inclined at a fourth angle with respect to the horizontal plane. The fourth angle may be greater than the third angle.

The movable part may further include a cleaning part coupled to the frame.

In another embodiment of the present disclosure, there is provided a cleaner including a housing including a suction opening, a cyclone part configured to separate dust, and a dust bin configured to store dust separated at the cyclone part; and a frame configured to be movable between a first position and a second position in the housing and disposed such that at least a portion thereof faces the suction opening at the first position, wherein the frame may include a frame body disposed to surround an axis of a cyclone flow of the cyclone part, an upper flow path allowing air to flow therethrough along the frame body may be disposed at an upper side of the frame body in the housing, and a lower flow path allowing air to flow therethrough along an inner circumferential surface of the cyclone part may be provided at a lower side of the frame body. The second position may be a position lower than the first position.

The cleaner may further include: a communicating flow path located between the frame body and the housing and configured to connect the upper flow path and the lower flow path.

The frame body may include a flow path body forming the upper flow path and having an inclination varied in a circumferential direction of the frame body.

The flow path body may include a first portion inclined by a first angle with respect to a horizontal plane and a second portion extending from the first portion and inclined by a second angle smaller than the first angle with respect to the horizontal plane.

A height of the upper flow path at the second portion may be higher than a height of the upper flow path at the first portion.

The frame body may further include a guide body extending from the flow path body and configured to guide air or dust in the upper flow path to the lower flow path.

At least a portion of the flow path body may be inclined in a direction toward to the axis of the cyclone flow from an upper side to a lower side. The guide body may be inclined in a direction away from the axis of the cyclone flow from the upper side to the lower side.

A distance between a portion of the guide body and an inner circumferential surface of the cyclone part may be greater than a distance between the flow path body and the inner circumferential surface of the cyclone part.

The frame body may further include a first body extending from the flow path body and configured to guide air suctioned through the suction opening to the lower flow path. An inclination angle of the first body with respect to the horizontal plane may be greater than an inclination angle of the flow path body.

In another embodiment of the present disclosure, there is provided a cleaner including a housing including a suction opening, a cyclone part configured to separate dust, and a dust bin configured to store dust separated at the cyclone part; and a frame configured to be movable between a first position and a second position in the housing and disposed such that at least a portion thereof faces the suction opening at the first position, wherein the frame may include a frame body disposed to surround an axis of a cyclone flow of the cyclone part at the first position, and the frame body may include an inner extension wall extending in a circumferential direction based on the axis of the cyclone flow of the cyclone part, an outer extension wall spaced apart from the inner extension wall in a radial direction, and a flow path body configured to connect the inner extension wall and the outer extension wall.

The inner extension wall, the outer extension wall, and the flow path body may form an air flow path through which a portion of the air suctioned through the suction opening may flow.

The second position is a position lower than the first position.

The flow path body may include a first portion inclined by a first angle with respect to the horizontal plane and a second portion extending from the first portion and inclined by a second angle smaller than the first angle with respect to the horizontal plane. An outer end of the second portion may be located lower than an outer end of the first portion.

A portion of the flow path body may be parallel to the horizontal plane. For example, the second portion may be parallel to the horizontal plane.

A height of the outer extension wall at the second portion may be lower than a height of the outer extension wall at the first portion.

The height of the outer extension wall at the first portion may be higher than the height of the inner extension wall at the first portion.

The cleaner may further include an additional body extending from the flow path body to the opposite side of the first portion with respect to the second portion.

The first portion may be inclined in a direction toward the axis of the cyclone flow from an upper side to a lower side. The additional body may be inclined in a direction away from the axis of the cyclone flow from the upper side to the lower side.

A radius of a portion of the additional body based on the center of the frame body may be smaller than a radius of the first portion.

The cleaner may further include an additional body extending from the flow path body to the opposite side of the second portion based on the first portion. An inclination angle of the additional body with respect to the horizontal plane may be greater than an inclination angle of the first portion.

A circumferential length of the flow path body may be longer than a circumferential length of the additional body.

A height of the air flow path at the second portion may be higher than a height of the air flow path at the first portion.

The frame body may further include an additional body facing the suction opening at the first position and having an inclination angle larger than that of the flow path body with respect to a horizontal plane.

In another aspect of the present disclosure, there is provided a cleaner including: a housing including a suction opening, a cyclone part configured to separate dust, and a dust bin configured to store dust separated at the cyclone part; and a frame configured to be movable between a first position and a second position in the housing and disposed such that at least a portion thereof faces the suction opening at the first position, wherein the frame includes: a frame body disposed to surround an axis of a cyclone flow of the cyclone part, and at least a portion of the frame body has an inclination varied in a circumferential direction to form an air flow path through which a portion of the air suctioned through the suction opening may flow.

The air flow path is formed on an upper side of the frame body, and another portion of the air suctioned through the suction opening may flow to a lower side of the frame body. The second position may be a position lower than the first position.

An inclination of at least a portion of the frame body with respect to a horizontal plane may decrease in a direction away from the suction opening in a circumferential direction.

The frame body may include a first portion and a second portion located farther from the suction opening than the first portion. Upper surfaces of the first portion and the second portion may form the air flow path. A height of the air flow path at the second portion may be higher than a height of the air flow path at the first portion.

An inclination angle of the second portion with respect to the horizontal plane may be smaller than an inclination angle of the first portion with respect to the horizontal plane.

The frame body may include an outer extension wall configured to connect the first portion and the second portion and configured to act as an outer wall of the air flow path and an inner extension wall inwardly spaced apart from the outer extension wall and configured to act as an inner wall of the air flow path.

A height of the outer extension wall at the second portion may be lower than a height of the outer extension wall at the first portion.

The frame body may further include a third portion located on the opposite side of the first portion with respect to the second portion. The first portion may be inclined in a direction toward the axis of the cyclone flow from the upper side to the lower side, and the third portion may be inclined in a direction away from the axis of the cyclone flow from the upper side to the lower side.

A radius of a portion of the third portion with respect to the center of the frame body may be smaller than a radius of the first portion.

The frame body may further include a fourth portion located on the opposite side of the second portion with respect to the first portion. An inclination angle of the fourth portion with respect to the horizontal plane may be greater than the inclination angle of the first portion.

BRIEF DESCRIPTION OF THE DRAWINGS

The accompanying drawings constitute a part of this specification and illustrate an embodiment of the present disclosure and together with the specification, explain the present disclosure

DETAILED DESCRIPTION OF THE DISCLOSURE

Figure 1:
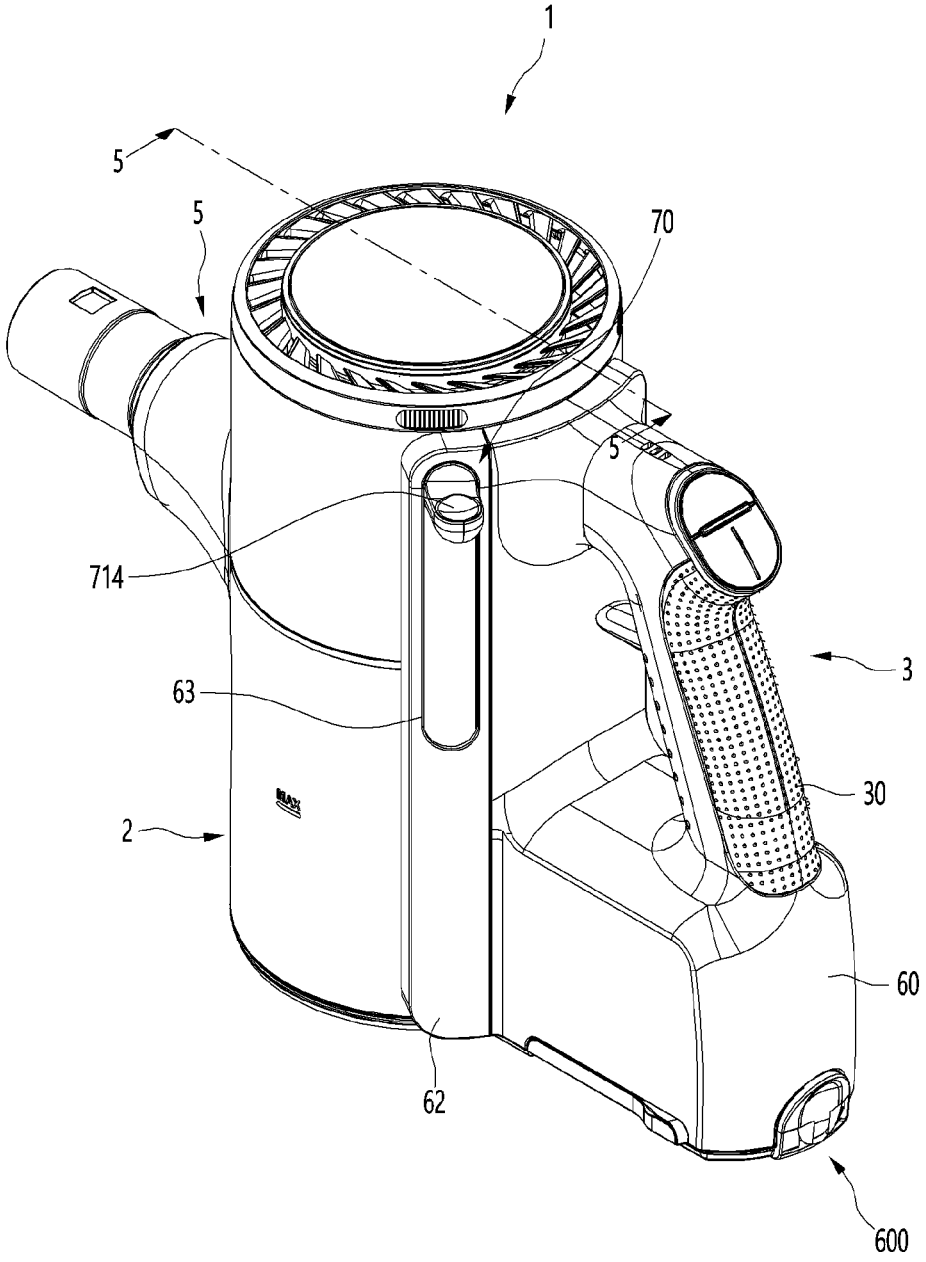
FIG. 1 is a perspective view of a cleaner according to an embodiment of the present disclosure.

Reference will now be made to the exemplary embodiments illustrated in the drawings, and specific language will be used here to describe the same. It will nevertheless be understood that no limitation of the scope of the invention is thereby intended. Alterations and further modifications of the inventive features illustrated here, and additional applications of the principles of the inventions as illustrated here, which would occur to a person skilled in the relevant art and having possession of this disclosure, are to be considered within the scope of the invention.

As used herein, a term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, features described with respect to certain embodiments may be combined in or with various other embodiments in any permutational or combinatory manner. Different aspects or elements of example embodiments, as disclosed herein, may be combined in a similar manner.

Various terminology used herein can imply direct or indirect, full or partial, temporary or permanent, action or inaction. For example, when an element is referred to as being "on," "connected" or "coupled" to another element, then the element can be directly on, connected or coupled to the other element or intervening elements can be present, including indirect or direct variants. In contrast, when an element is referred to as being "directly connected" or "directly coupled" to another element, there are no intervening elements present Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component.

Figure 2:
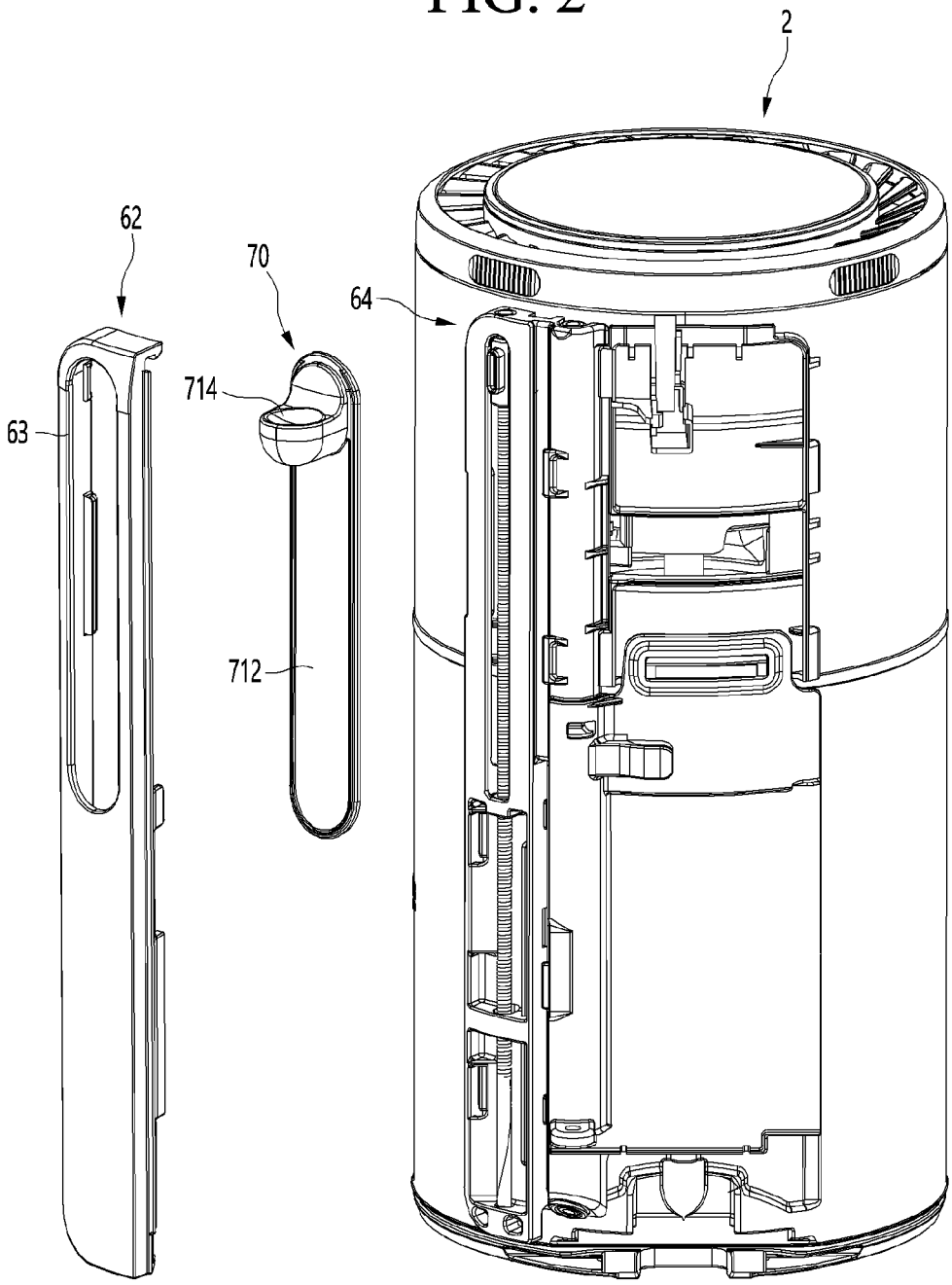
FIG. 2 is a perspective view showing a state where a handle part is separated from a cleaner according to an embodiment of the present disclosure.
Figure 3:
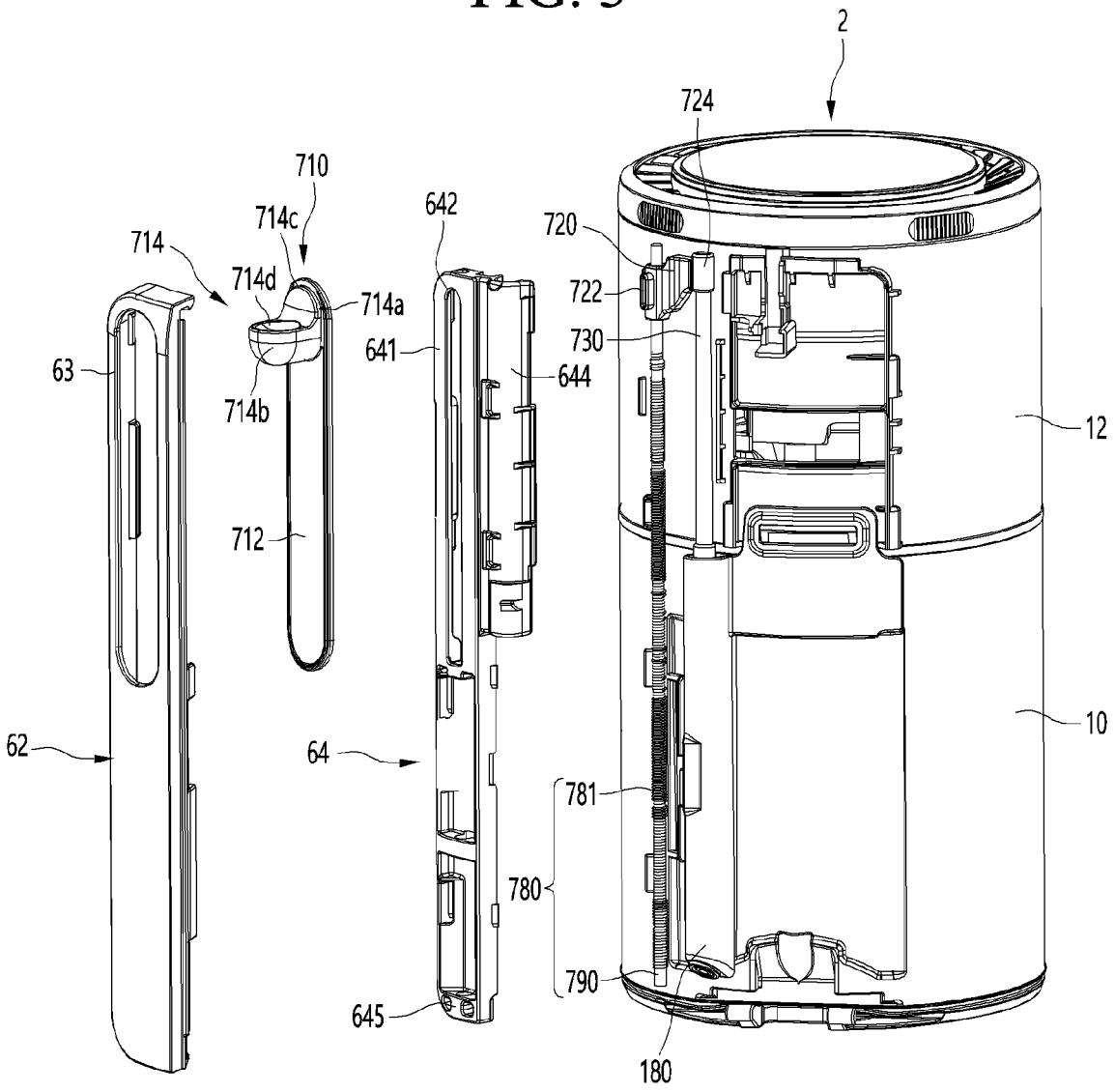
FIG. 3 is a view showing a state where a guide frame is separated from FIG. 2.
Figure 4:
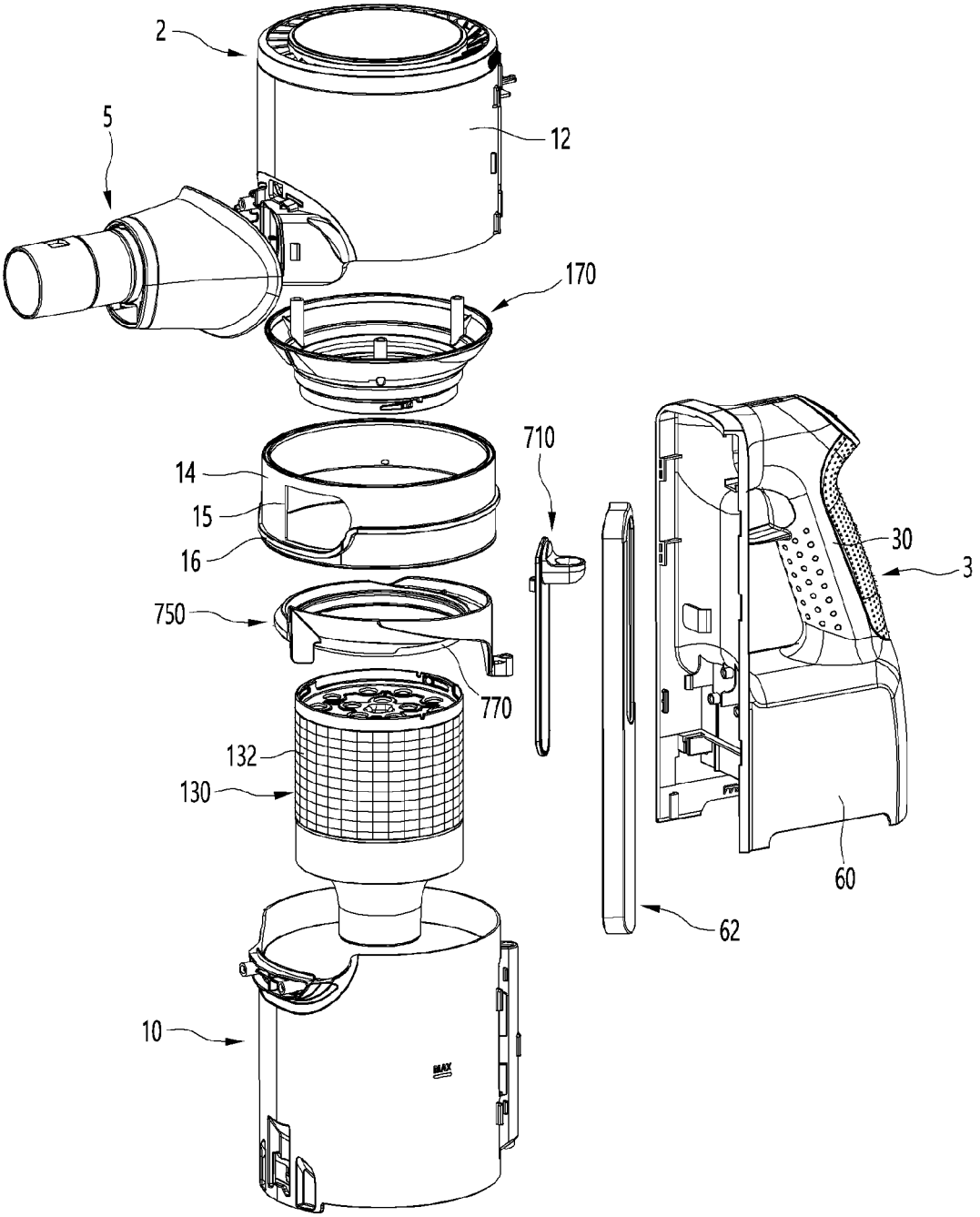
FIG. 4 is an exploded perspective view of a cleaner according to an embodiment of the present disclosure.
Figure 5:
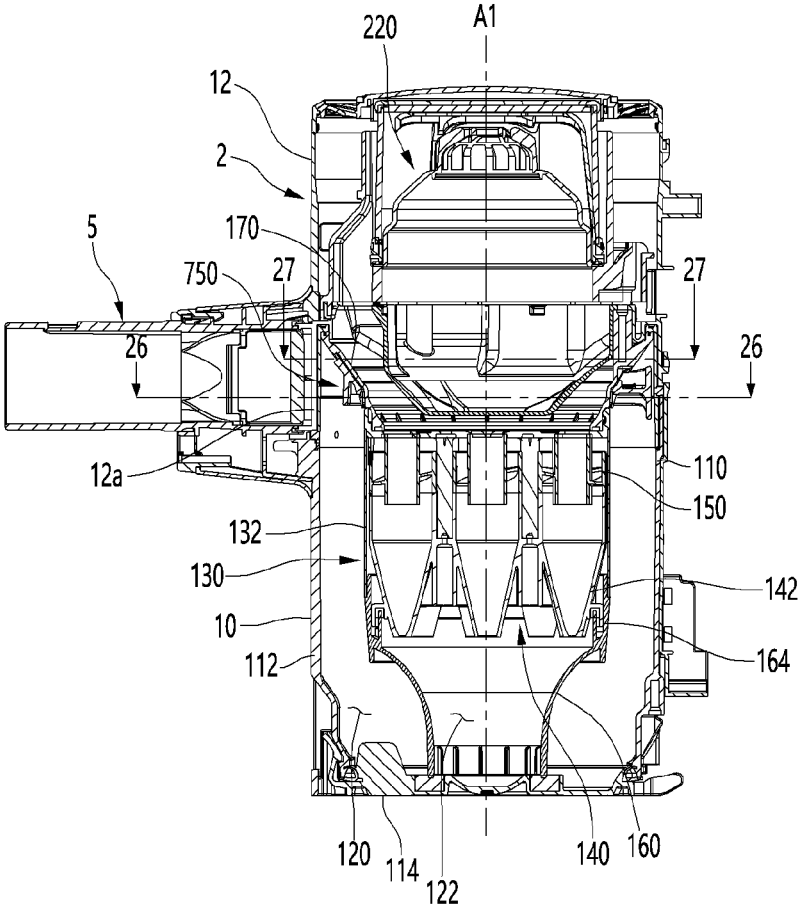
FIG. 5 is a cross-sectional view taken along line 5-5 of FIG. 1.

FIG. 1 is a perspective view of a cleaner according to an embodiment of the present disclosure. FIG. 2 is a perspective view showing a state where a handle part is separated from a cleaner according to an embodiment of the present disclosure. FIG. 3 is a view showing a state where guide frame is separated from FIG. 2. FIG. 4 is an exploded perspective view of a cleaner according to an embodiment of the present disclosure. FIG. 5 is a cross-sectional view taken along line 5-5 of FIG. 1.

Referring to FIGS. 1 to 5, the cleaner 1 may include a main body 2. The cleaner 1 may further include a suction part 5 (or suction inlet) through which air containing dust is suctioned. The suction part 5 may guide the air containing dust to the main body 2.

The cleaner 1 may further include a handle part 3 coupled to the main body 2. The handle part 3 may be located on the opposite side of the suction part 5 in the main body 2. However, the positions of the suction part 5 and the handle part 3 are not limited thereto.

The main body 2 may separate the dust suctioned into the inside through the suction part 5 and store or hold the separated dust.

In one example, the main body 2 may include a dust separator. The dust separator may include a first cyclone part 110 capable of separating dust by a cyclone flow, e.g., helical pattern. The first cyclone part 110 may communicate with the suction part 5.

The air and dust suctioned through the suction part 5 spirally flows along an inner circumferential surface of the first cyclone part 110.

The dust separator may further include a second cyclone part 140 for separating dust from the air discharged from the first cyclone part 110.

The second cyclone part 140 may include a plurality of cyclone bodies 142 arranged in parallel. The air discharged from the first cyclone part 110 may be divided into the plurality of cyclone bodies 142 and pass therethrough.

The dust separator may include a single cyclone part or more than one cyclone part.

The main body 2 may be formed in a cylindrical shape, for example, and an outer shape thereof may be formed by a plurality of housings.

In one embodiment, the main body 2 may include a first housing 10 having a substantially cylindrical shape and a second housing 12 coupled to an upper side of the first housing 10 and having a substantially cylindrical shape.

An upper portion of the first housing 10 may define the first cyclone part 110, and a lower portion of the first housing 10 may define a dust bin 112 for storing dust separated from the first cyclone part 110. The dust bin 112 may include a first dust storage 120 storing dust separated from the first cyclone part 110.

A lower side of the first housing 10 (e.g., a lower side of the dust bin 112) may be opened and closed by a housing cover 114 that rotates by a hinge.

To seal a boundary between the first housing 10 and the second housing 12 in a state where the first housing 10 and the second housing 12 are coupled, the cleaner 1 may further include a sealing member 16 and a support body 14 supporting the sealing member 16.

Upper and lower sides of each of the first housing 10 and the second housing 12 are open. That is, each of the housings 10 and 12 may include an upper opening and a lower opening.

The support body 14 may be formed in a cylindrical shape. Here, an outer diameter of the support body 14 may be the same as or less than an inner diameter of the first housing 10 so that the support body 14 may be inserted into the first housing 10 through the upper opening of the first housing 10.

Likewise, the outer diameter of the support body 14 may be the same as or less than an inner diameter of the second housing 12 so that the support body 14 may be inserted into the second housing 12 through the lower opening of the second housing 12.

The support body 14 may include a communication opening 15 through which air passes or flows through. The communication opening 15 may communicate with the suction part 5.

The sealing member 16 may be coupled to the support body 14 to surround an outer circumferential surface of the support body 14. For example, the sealing member 16 may be integrally formed with the support body 14 by an insert injection molding process. Alternatively, the sealing member 16 may be coupled or adhered to the outer circumferential surface of the support body 14, such as by an adhesive.

The main body 2 may include a suction opening 12*a* through which air guided through the suction part 5 passes or flows through.

One of the first housing 10 and the second housing 12 may include the suction opening 12*a*, or the first housing 10 may form a part of the suction opening 12*a* and the second housing 12 may form another part of the suction opening 12*a*.

Hereinafter, an embodiment in which the second housing 12 includes the suction opening 12*a* will be described.

When the second housing 12 is coupled to the first housing 10, the suction opening 12*a* of the second housing 12 and the communication opening 15 of the support body 14 are aligned.

The suction opening 12*a* is aligned with the suction part 5. With such configuration, dust and air may be introduced into the first cyclone part 110 through the inside of the suction part 5, the suction opening 12*a*, and the communication opening 15.

In this embodiment, the support body 14 may be omitted. In this embodiment, an upper end of the first housing 10 may be in direct contact a lower end of the second housing 12. In addition, dust and air may flow into the first cyclone part 110 through the suction opening 12*a* after passing through the inside of the suction part 5.

In the present disclosure, a configuration for guiding air from the suction part 5 to the first cyclone part 110 may be referred to as a suction passage of the main body 2.

Accordingly, the suction passage may include only the suction opening 12*a* or may include the suction opening 12*a* and the communication opening 15.

The main body 2 may further include a filter part 130 disposed to surround the second cyclone part 140.

The filter part 130 may be formed in a cylindrical shape, for example, and guide air separated from dust in the first cyclone part 110 to the second cyclone part 140. The filter part 130 filters dust from air in the process in which air flows or passes there through.

The filter part 130 may be arranged to surround an axis A1 of a cyclone flow of the first cyclone part 110.

To this end, the filter part 130 may include a mesh portion 132 having a plurality of holes. The mesh portion 132 may be formed of a metal material but is not limited thereto. Since the mesh portion 132 filters air, dust may accumulate on the mesh portion 132, and thus the mesh portion 132 may need to be cleaned.

In the present disclosure, the cleaner 1 may further include a compression mechanism 70 capable of compressing dust stored in the first dust storage 120.

Since capacity of the first dust storage 120 is limited, the amount of dust stored in the first dust storage 120 may accumulate during repeated cleaning, and thus a usage time of and the number of times the cleaner is used may be limited.

The user may cause or manipulate the housing cover 114 to open the first dust storage 120 in order to remove dust of the first dust storage 120.

In this embodiment, when dust stored in the first dust storage 120 is compressed using the compression mechanism 70, density of the dust stored in the first dust storage 120 increases, and thus a volume thereof decreases.

Therefore, according to the present embodiment, the number of times for emptying the dust bin 112 is reduced, and accordingly, requiring less frequent emptying of the dust bin.

The compression mechanism 70 may also clean the mesh portion 132 during a movement process.

The compression mechanism 70 may include a movable part 750 movable in the main body 2, an operating part 710 (or manipulating part) operated by the user to move the movable part 750, and transfer parts 720 and 730 transferring an operation force of the operating part 710 to the movable part 750.

The movable part 750 may be form in a ring-like shape, for example, such that interference with a structure provided in the first dust storage 120 may be prevented. The operating part 710 may have a structure that the user may manually press.

The operating part 710 may be disposed outside the main body 2. For example, the operating part 710 may be located outside the first housing 10 and the second housing 12.

At least a portion of the operating part 710 may be located above the first housing 10. Also, at least a portion of the operating part 710 may be located above the movable part 750.

The operating part 710 may include a pressing part 714. The pressing part 714 may be located above the first housing 10 and the movable part 750.

The operating part 710 may include an operating part body 712. The operating part body 712 may have a vertical length that is longer than a horizontal width thereof. The pressing part 714 may protrude from an upper portion of the operating part body 712.

The pressing part 714 may protrude in the horizontal direction from the operating part body 712 in a state where the operating part body 712 is disposed in a vertical direction.

In one embodiment, the pressing part 714 may be located closer to an upper end than a lower end of the operating part body 712. The pressing part 714 may protrude from a position spaced apart downward from the upper end of the operating part body 712.

The pressing part 714 may include a first portion 714*a* protruding from the operating part body 712 and a second portion 714*b* additionally protruding from the first pressing part 714*a*.

The second portion 714*b* may protrude from a position spaced apart by a predetermined distance in a downward direction from an upper end 714*c* of the first portion 714*a*.

The user may move the operating part 710 in a downward direction by pressing an upper surface 714*d* of the second portion 714*b*. Therefore, an upper surface 714*d* of the second portion 714*b* may function as a pressing surface.

The operating part 710 may further include a coupling projection (See 716 of FIG. 6) located on the opposite side of the pressing part 714 in the operating part body 712.

The handle part 3 may include a handle body 30 for the user to grip or manipulate and a battery housing 60 disposed below the handle body 30 and accommodating a battery 600.

The handle body 30 and the battery housing 60 may be disposed in an up-down direction, and the handle body 30 may be located above the battery housing 60.

The handle part 3 may guide movement of the operating part 710, while covering a portion of the operating part 710.

In one embodiment, the handle part 3 may further include an operating part cover 62. The operating part cover 62 may be located on the side of the handle body 30 and the battery housing 60.

The operating part cover 62 may be formed integrally with the handle body 30 and the battery housing 60 or may be formed separately from the handle body 30 and the battery housing 60.

If the operating part cover 62 is formed separately from the handle body 30 and the battery housing 60, the operating part cover 62 may be coupled to the main body 2.

In a state where the user grips the handle body 30 by a right hand, the operating part 710 may be located on the left of the handle body 30. Of course, in a state where the user grips the handle body 30 by a left hand, the operating part 710 may be located on the right of the handle body 30. With such configuration, the user may more easily operate the operating part 710 by a hand that does not grip the handle body 30.

The operating part 710 may move in a direction parallel to the axis A1 of the cyclone flow of the first cyclone part 110.

For example, the axis A1 of the cyclone flow of the first cyclone part 110 may extend in the up-down direction in a state where the dust bin 112 is placed on the floor. Therefore, the operating part 710 may also be moved in the up-down direction in a state where the dust bin 112 is placed on the floor.

A slot 63 may be provided on the operating part cover 62 for movement of the operating part 710. The pressing part 714 of the operating part 710 may penetrate the slot 63.

A vertical length of the operating part body 712 may be longer than a vertical length of the slot 63. A horizontal width of the operating part body 712 may be longer than a horizontal width of the slot 63.

The horizontal width of the pressing part 714 may be the same as or less than the horizontal width of the slot 63. The vertical length of the pressing part 714 may be less than the vertical length of the slot 63.

A protruding length of the pressing part 714 may be longer than a front-rear width of the operating part cover 62. Therefore, the pressing part 714 may penetrate the slot 63 and may protrude outside the operating part cover 62 through the slot 63.

The horizontal width of the operating part body 712 may be less than the horizontal width of the operating part cover 62. The vertical length of the operating part body 712 may be less than the horizontal width of the operating part cover 62.

A front-rear width of the operating part body 712 may be less than a front-rear width of the operating part cover 62. The operating part cover 62 may form a space for the operating part body 712 to locate. The operating part body 712 may move in the up-down direction in a state where the operating part body 712 is located in the operating part cover 62.

In the operating part cover 62, the operating part body 712 may move between the first position and the second position.

For example, the first position is a position when the operating part body 712 has moved to the top, and the second position is a position when the operating part body 712 has moved to the bottom.

In a state where no external force is applied to the operating part 710, the operating part body 712 may be located at the first position. The operating part body 712 may cover the slot 63 in a state where the operating part body 712 is located at the first position.

In one embodiment, in a state where the operating part body 712 is located at the first position, the operating part body 712 may fully cover the slot 63 inside the operating part cover 62. Accordingly, in a state where the operating part body 712 is located at the first position, the operating part body 712 may be exposed to the outside of the slot 63 and a space inside the operating part cover 62 may be prevented from being exposed.

The slot 63 may also extend in a direction parallel to the extending direction of the axis A1 of the cyclone flow of the first cyclone part 110.

In this embodiment, since the extending direction of the axis A1 of the cyclone flow is the up-down direction, for example, the "up-down direction" described below may be understood as the extending direction of the axis A1 of the cyclone flow.

Since the movable part 750 is located in the main body 2, the operating part 710 is located outside the main body 2, one portion of the transfer parts 720 and 730 may be located outside the main body 2 and the other portion thereof may be located inside the main body 2 to connect the movable part 750 and the operating part 710.

Portions of the transfer parts 720 and 730 may penetrate the main body 2. Portions of the transfer parts 720 and 730 located outside the main body 2 may be covered by the handle part 3.

The transfer parts 720 and 730 may include a first transfer part 720. The first transfer part 720 may be coupled to the operating part 710. For example, the first transfer part 720 may include a coupling projection 722. The coupling projection 722 may be coupled to a projection coupling part (not shown) formed at the operating part body 712.

The coupling projection 722 may be formed to have a vertical length larger than a horizontal width thereof. The coupling projection 722 may restrict relative rotation of the operating part 710 with respect to the first transfer part 720 in a horizontal direction.

The transfer parts 720 and 730 may further include a second transfer part 730 coupled with the movable part 750. A portion of the second transfer part 730 may be located inside the main body 2 and the other portion thereof may be located outside the main body 2.

The second transfer part 730 may be directly connected to the first transfer part 720 or may be connected by an additional transfer part.

For example, FIG. 3 illustrates an embodiment where the second transfer part 730 is directly connected to the first transfer part 720. The first transfer part 720 may include a coupling part 724 to which the second transfer part 730 may be coupled.

The second transfer part 730 may extend in a direction parallel to the axis A1 of the cyclone flow.

In the case of this embodiment, although not limited thereto, the center of the movable part 750 may be located on the axis A1 of the cyclone flow or a vertical line passing through the center of the movable part 750 may be parallel to the axis A1 of the cyclone flow.

In this embodiment, the operating part 710 is disposed at a position eccentric from the center of the movable part 750. Therefore, eccentricity of the movable part 750 should be prevented in the process in which the movable part 750 moves up and down by the operation of the operating part 710.

If the movable part 750 moves up and down in an eccentric state, the movable part 750 may not form a horizontal state and may not move smoothly and the movable part 750 may not move accurately to the standby position.

When the transfer part for transferring an operation force of the operating part 710 to the movable part 750 includes one transfer part, a possibility that the movable part 750 is eccentric in the process of operating the operating part 710 is high.

For example, when the operating part 710 is directly connected to the movable part 750 or connected by a single transfer part, a path through which the operation force of the operating part 710 is transferred to the movable part 750 is relatively short.

If the operating part 710 is operated in an eccentric state with respect to a vertical line, the effect of eccentricity of the operating part 710 may directly act on the movable part 750 so there is a greater possibility that the movable part 750 is moved in the eccentric state.

However, as in the present disclosure, when the transfer part includes a plurality of transfer parts and transfers the operation force of the operating part to the movable part 750, even if the operating part 710 is eccentric with respect to the vertical line in the process of operating the operating part 710, the plurality of transfer parts may reduce the influence of the eccentric to minimize the amount of eccentricity of the movable part 750.

The main body 2 may further include a protruding body 180 for guiding the second transfer part 730. The protruding body 180 is, for example, present in a form protruding from the outside of the first housing 10.

The protruding body 180 may extend in a direction parallel to the extending direction of the axis A1 of the cyclone flow of the first cyclone part 110.

The protruding body 180 communicates with an internal space of the first housing 10, and the second transfer part 730 may move in the protruding body 180.

The cleaner 1 may further include a support mechanism 780 elastically supporting the compression mechanism 70.

The support mechanism 780 may include an elastic member 781 providing an elastic force to the compression mechanism 70. The elastic member 781 may provide the elastic force to the operating part 710 or the transfer parts 720 and 730. Hereinafter, an embodiment where the elastic member 781 supports the operating part 710 will be described.

The elastic member 781 may be disposed spaced apart from the second transfer part 730 in the horizontal direction. The elastic member 781 may be, for example, a coil spring and may be expanded and contracted in the up-down direction—but is not limited to such mechanism.

Here, at the first position of the operating part 710 (the position of the operating part 710 before the user presses the operating part 710), a length of the elastic member 781 may be longer than a length of the second transfer part 730.

When the length of the elastic member 781 is longer than the length of the second transfer part 730, the operating part 710 may be supported using the elastic member 781 having a low modulus of elasticity.

In this case, a required force may be reduced when pressing the operating part 710. In addition, when the operating part 710 is returned to its original position by the elastic member 781, noise that may occur as the upper end 714*c* of the first portion 714*a* in the pressing part 714 collides with a surface forming the slot 63 of the operating part cover 62 may also be reduced.

The support mechanism 780 may further include a support bar 790 supporting the elastic member 781 so that a horizontal movement of the elastic member 781 is limited in the vertical movement process of the operating part 710.

The support bar 790 may be formed in a cylindrical shape (not limited thereto). A vertical length of the support bar 790 may be longer than a vertical length of the elastic member 781.

The elastic member 781 may be disposed to surround the support bar 790. That is, the support bar 790 may be located at an inner region of the coil-shaped elastic member 781. An outer diameter of the support bar 790 may be to the same as or smaller than an inner diameter of the elastic member 781.

One end of the support bar 790 may be coupled to the main body 2 or a transfer part cover, which will be described later. The first transfer part 720 may be coupled to the other end of the support bar 790.

Figure 6:
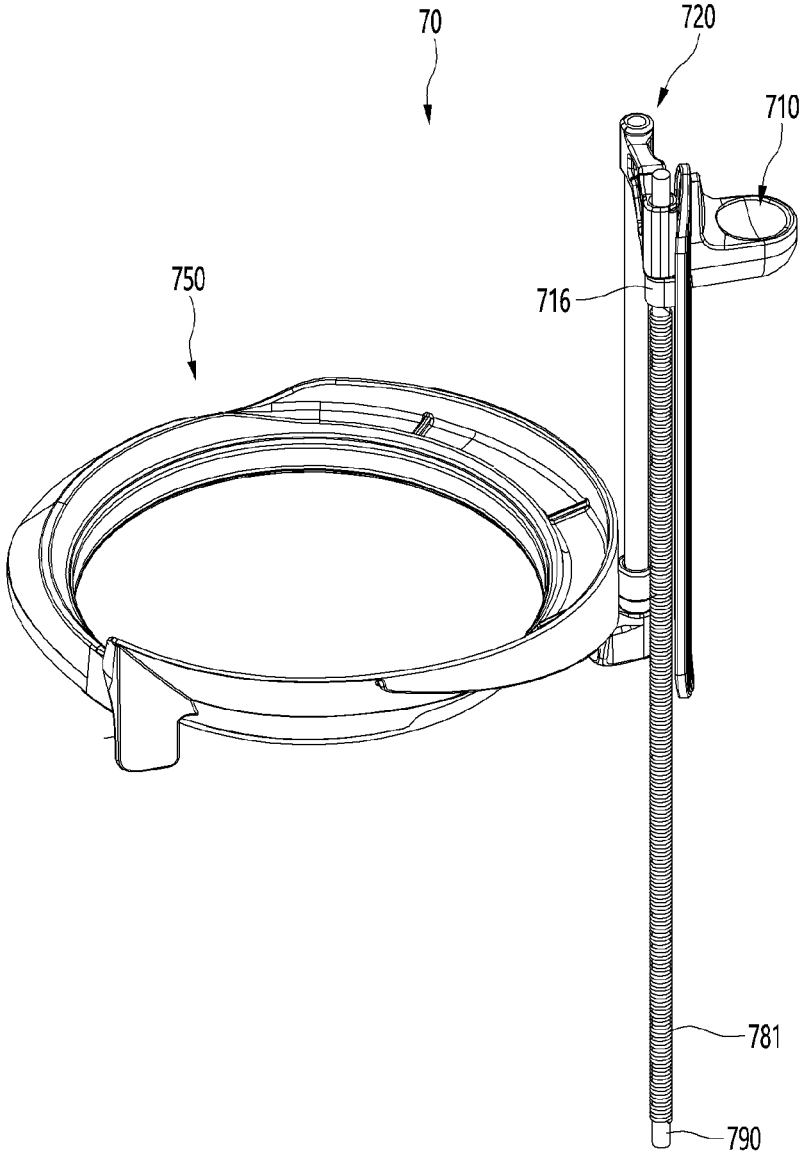
FIG. 6 is a perspective view of a compression mechanism according to an embodiment of the present disclosure.

Here, the support bar 790 may be coupled to the first transfer part 720 after passing through the coupling projection (See 716 in FIG. 6). A portion of the coupling projection (See 716 in FIG. 6) may be coupled to the first transfer part 720.

The upper end of the elastic member 781 may contact the lower side of the coupling projection (see 716 in FIG. 6).

The other end of the support bar 790 may be an upper end. The upper end of the support bar 790 may be coupled to penetrate the first transfer part 720.

The first transfer part 720 may move up and down along the support bar 790. Accordingly, the support bar 790 may guide a vertical movement of the first transfer part 720. Therefore, the support bar 790 may be referred to as a guide bar.

The cleaner 1 may further include a transfer part cover 64 covering the transfer parts 720 and 730.

The transfer part cover 64 may be coupled to the main body 2 in a state of covering the transfer parts 720 and 730. The operating part cover 62 may cover at least a portion of the transfer part cover 64. In this embodiment, the transfer part cover 64 may be omitted and the operating part cover 62 may function as the transfer part cover 64.

The transfer part cover 64 may also cover the support mechanism 780.

The first portion 641 of the transfer part cover 64 may cover the first transfer part 720, the support bar 790, and the elastic member 781 at the side of the protruding body 180.

The second portion 644 of the transfer part cover 64 may be located above the protruding body 180 and may cover the second transfer part 730.

The transfer part cover 64 may include a slot 642 at which the coupling projection 722 of the first transfer part 720 is located. The slot 642 may extend in the up-down direction.

The transfer part cover 64 may have a bar coupling part 645 to which the support bar 790 may be coupled.

Meanwhile, the main body 2 may further include a suction motor 220 for generating a suction force. The suction force generated by the suction motor 220 may act on the suction part 5. The suction motor 220 may be located in the second housing 12, for example.

The suction motor 220 may be located above the dust bin 112 and the battery 600 with respect to the extending direction of the axis A1 of the cyclone flow of the first cyclone part 110.

The main body 2 may further include an air guide 170 guiding air passing or flowing through the filter part 130 to the suction motor 220.

In one example, the air guide 170 may guide air discharged from the second cyclone part 140 to the suction motor 220.

The second cyclone part 140 may be coupled to a lower side of the air guide 170. The filter part 130 may surround the second cyclone part 140 in a state of being coupled to the second cyclone part 140.

Therefore, the filter part 130 may also be located below the air guide 170. The movable part 750 may be disposed at a position surrounding the air guide 170 in a standby position.

The movable part 750 may include a cleaning part 770 for cleaning the filter part 130.

In this embodiment, a position of the movable part 750 in a state where the operating part 710 is not operated (an initial position of the operating part 710) may be referred to as a standby position (or the first position). That is, the position of the movable part 750 when the operating part 710 is located at the first position may be referred to as the standby position. A position of the movable part 750 when the operating part 740 is located at the second position may be referred to as a dust compression position (or the second position).

At the standby position of the movable part 750, the entirety of the cleaning part 770 may be disposed not to overlap the filter part 130 in a direction in which air passes through the filter part 130. For example, at the standby position of the movable part 750, the entirety of the cleaning part 770 may be located above the filter part 130. Accordingly, at the standby position of the movable part 750, the cleaning part 770 may be prevented from acting as a flow resistance in the process in which air passes through the filter part 130.

A dust guide 160 may be provided below the second cyclone part 140. A lower side of the second cyclone part 140 may be coupled to an upper side of the dust guide 160. In addition, a lower side of the filter part 130 may be seated or accommodated on the dust guide 160.

The lower side of the dust guide 160 may be seated or accommodated on the housing cover 114. The dust guide 160 is spaced apart from the inner circumferential surface of the first housing 10 and divides or separates an internal space of the first housing into a first dust storage 120 storing dust separated at the first cyclone part 110 and a second dust storage 122 storing dust separated at the second cyclone part 140.

The inner circumferential surface of the first housing 10 and the outer circumferential surface of the dust guide 160 may define or form the first dust storage 120, and the inner circumferential surface of the dust guide 160 may define or form the second dust storage 122.

Hereinafter, the compression mechanism 70 will be described in more detail.

Figure 7:
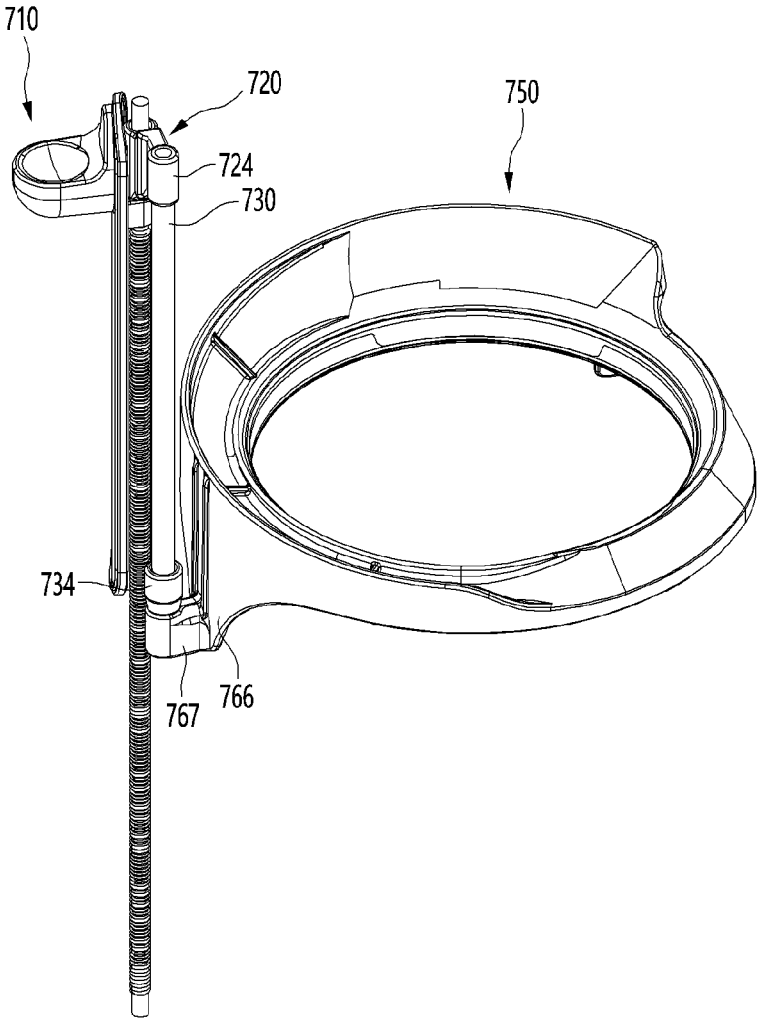
FIG. 7 is a perspective view of a compression mechanism according to an embodiment of the present disclosure.
Figure 8:
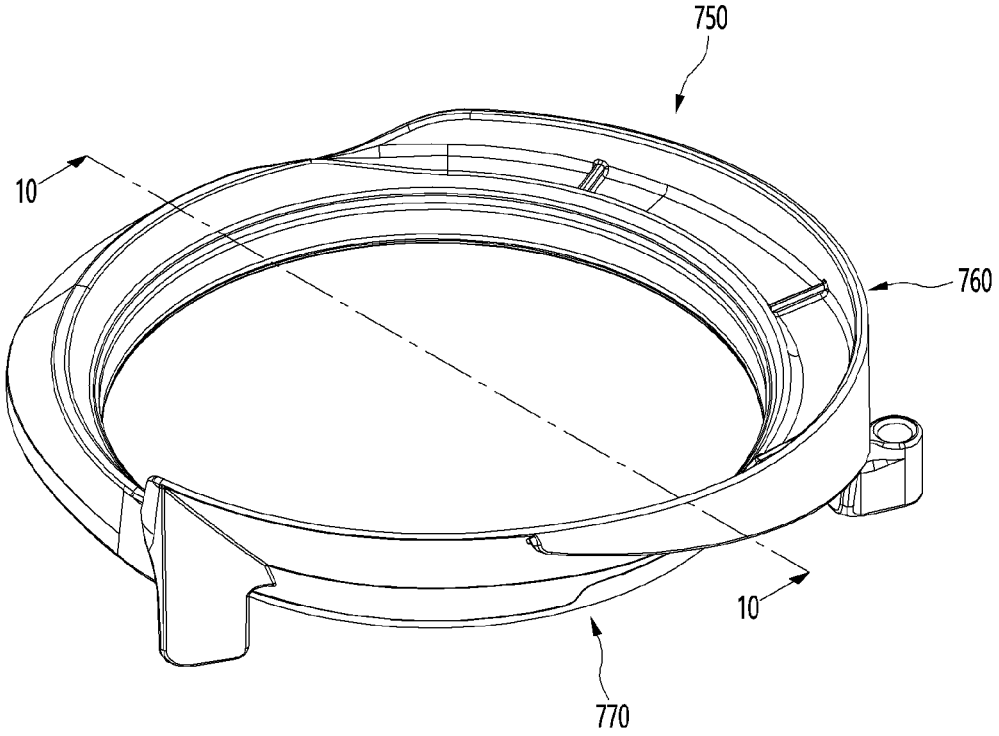
FIG. 8 is a perspective view of a movable part according to an embodiment of the present disclosure.
Figure 9:
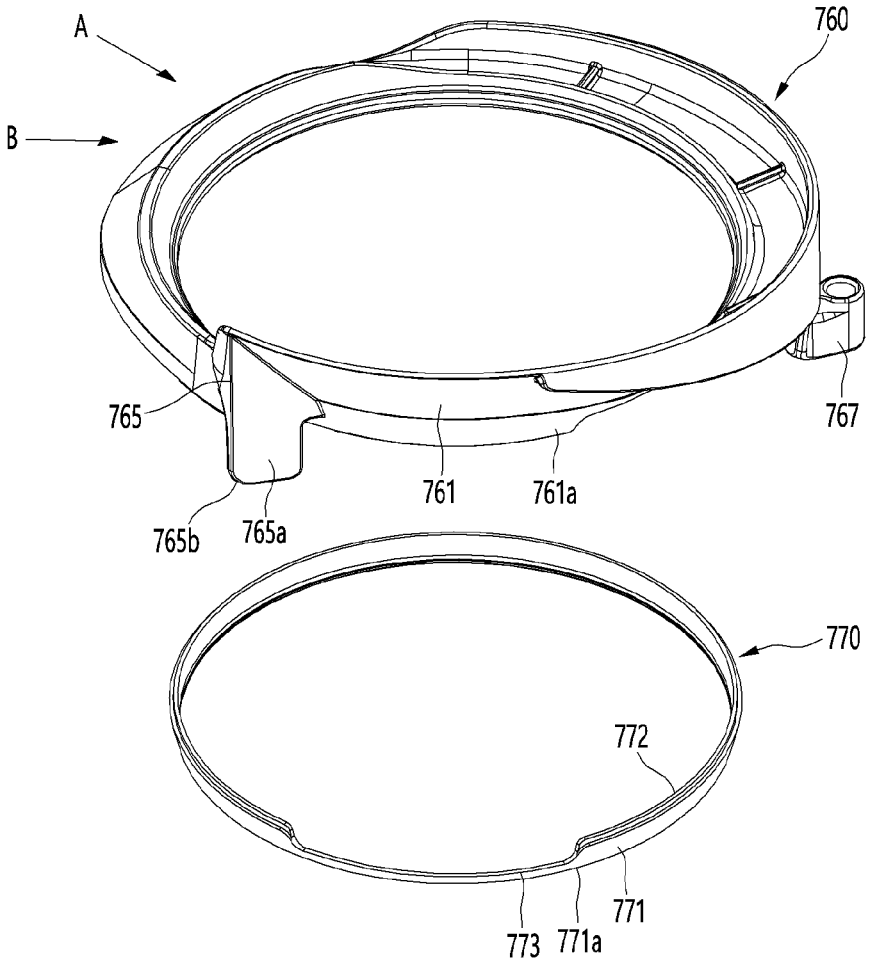
FIG. 9 is an exploded perspective view of a movable part according to an embodiment of the present disclosure.
Figure 10:
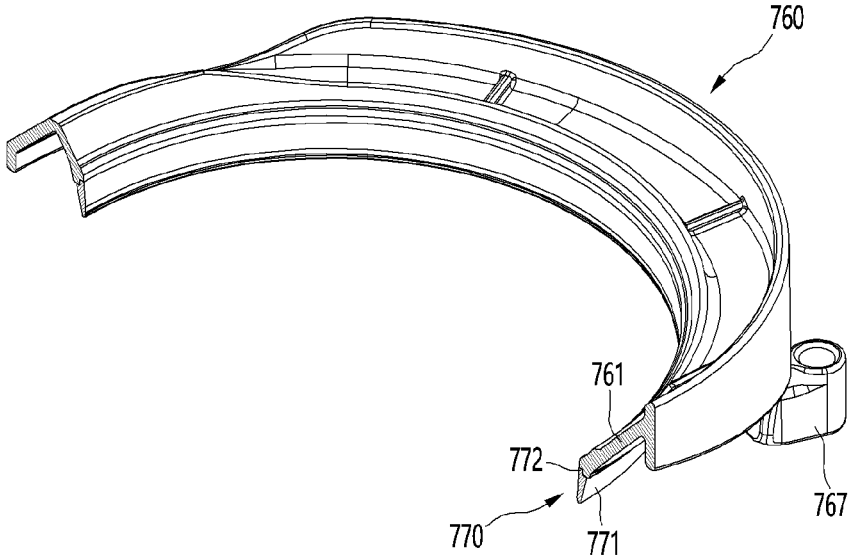
FIG. 10 is a cross-sectional view taken along line 10-10 of FIG. 8.

FIGS. 6 and 7 are perspective views of a compression mechanism according to an embodiment of the present disclosure. FIG. 8 is an exploded perspective view of a movable part according to an embodiment of the present disclosure. FIG. 9 is an exploded perspective view of a movable part according to an embodiment of the present disclosure. FIG. 10 is a cross-sectional view taken along line 10-10 of FIG. 8.

Referring to FIGS. 6 to 10, the movable part 750 may include a frame 760.

The frame 760 may be disposed to surround the axis A1 of the cyclone flow. The frame 760 may be formed in a ring-like shape around the axis A1 of the cyclone flow.

The frame 760 may compress dust stored in the first dust storage 120. Therefore, the frame 760 may have sufficient rigidity for preventing deformation during a pressing process, while effectively compressing dust during the process of compressing dust. For example, the frame 760 may be an injection-molded material or may be formed of a metal material (not limited to any particular material).

A maximum diameter of the frame 760 may be less than a diameter of an inner circumferential surface of the first cyclone part 110. Therefore, the frame 760 may be moved up and down in a state of being spaced apart from the inner circumferential surface of the first cyclone part 110.

In the present embodiment, even if the movable part 750 moves up and down in an eccentric state, frictional contact of the movable part 750 with the inner circumferential surface of the first housing 10 (e.g., the first cyclone part 110 and/or dust bin 112) may be prevented.

In addition, when the frame 760 is spaced apart from the inner circumferential surface of the first cyclone part 110, air and dust suctioned into the first cyclone part 110 may flow downward through the inner circumferential surface of the first cyclone part 110 and the frame 760 in a state where the movable part 750 has moved downward during the cleaning process.

The frame 760 may support the cleaning part 770. The cleaning part 770 may be formed of an elastically deformable material. For example, the cleaning part 770 may be formed of a rubber material (not limited thereto).

The cleaning part 770 may be formed in a ring-like shape so that the cleaning part 770 may clean the entirety of the circumference of the cylindrical filter part 130 may be reduced or prevented. As another example, the cleaning part 770 may be formed of silicone or a fiber material.

When the cleaning part 770 is formed of an elastically deformable material, damage to the filter part 130 when the cleaning part 770 is in frictional contact with the filter part 130.

The movable part 750 may move from the standby position to a dust compression position.

The cleaning part 770 may standby at a position outside the filter part 130 at the standby position, and during a dust compression process, the cleaning part may wipe the outer surface of the filter part 130, while moving to the dust compression position.

The cleaning part 770 may include a cleaning end 771*a*. The cleaning end 771*a* may be in contact with the outer surface of the filter part 130 during the cleaning process.

In the present embodiment, since the cleaning part 770 is formed of an elastically deformable material, when the cleaning part is lowered and the cleaning end 771*a* comes into contact with the filter part 130, the cleaning part 770 may be elastically deformed outward in a radial direction of the filter part 130, and in the elastically deformed state, the cleaning end 771*a* may come into contact with the filter part 130.

Therefore, when the cleaning end 770 is lowered in a state where the cleaning end 771*a* is in contact with the circumference of the filter part 130, the cleaning end 771*a* removes dust adhered to the outer surface of the filter part 130.

In the present embodiment, since the cleaning end 771*a* is moved in contact with the filter part 130, the cleaning part 770 may reduce eccentricity of the movable part 750 in the vertically moving process.

In one example, in a state where the movable part 750 is inclined with respect to a horizontal direction, a contact force between a portion of the cleaning end 771*a* and the filter part 130 increases, so that the cleaning end 771*a* is deformed and inclination of the movable part 750 may be reduced.

The cleaning part 770 may include a first part 771 and a second part 772 extending upward from the first part 771.

A thickness of the second part 772 may be less than a thickness of the first part 771. The second part 772 may be coupled to a lower side of the frame 760.

For example, the cleaning part 770 may be coupled to the frame 760 by an insert injection molding process.

The cleaning part 770 may further include a depressed portion 773 recessed in a downward direction from the upper end. A lower extending portion 761*a* extending from the frame 760 may be located in the depressed portion 773. The lower extending portion 761*a* located in the depressed portion 773 may be aligned with the suction opening 12*a*.

The frame 760 may include a frame body 761 supporting the cleaning part 770.

At the standby position, a portion of the frame body 761 may be in contact with the outer surface of the air guide 170. A portion of the frame body 761 may surround an outer surface of the air guide 170 in a circumferential direction.

The frame 760 may further include a lower extension wall 766 extending in a downward direction from the frame body 761. The lower extension wall 766 may be rounded in the circumferential direction of the frame 760.

The lower extension wall 766 may function to press dust stored in the dust bin 112 in a downward direction while the movable part 750 is lowered. The lower extension wall 766 may be located, for example, at a portion where the outer wall 763 is formed at the frame body 761.

The frame 760 may further include a coupling part 767 extending outward from the lower extension wall 766.

The coupling part 767 may protrude in the horizontal direction from the lower extension wall 766. For example, the coupling part 767 may extend in a horizontal direction from a lower end 766*a* side of the lower extension wall 766. Accordingly, since the portion to which the operation force transferred from the transfer part is applied first acts on the lower extension wall 766, which is a position spaced apart from the frame body 761, eccentricity of the frame body 761 may be reduced.

In addition, in the present embodiment, since the coupling part 767 is located on the lower end 766*a* side of the lower extension wall 766, an increased in height of the cleaner 1 is prevented while a vertical movement stroke of the movable part 750 may increase.

That is, as the distance between the coupling part 767 and the pressing portion 714 of the operating part 710 increases, the vertical movement stroke of the movable part 750 may increase. When the vertical movement stroke of the movable part 750 increases, compression performance of dust stored in the first dust storage 120 may be improved.

The second transfer part 730 may be connected to the coupling part 767.

A buffer part 734 may be coupled to the second transfer part 730. The second transfer part 730 may be coupled to penetrate the buffer part 734. The buffer part 734 may be seated on an upper surface of the coupling part 767 in a state where the buffer part 734 is coupled to the second transfer part 730.

The second transfer part 730 may penetrate an upper wall of the protruding body 180.

The buffer part 734 functions to absorb a shock (e.g., force with respect to time) that occurs when the movable part 750 comes into contact with the upper side wall of the protruding body 180 in the process of moving from the dust compression position to the standby position, and accordingly, the occurrence of noise may be reduced.

The frame 760 may further include a frame guide 765 extending in a downward direction from the frame body 761. For example, the frame guide 765 may extend in a downward direction from an outer circumferential surface of the first body 762*a*, which will be described later.

The frame guide 765 may include a planar guide surface 765*a*. The guide surface 765*a* may guide a spiral flow of air in the process of air flowing through the suction part 5 (See FIG. 26). The guide surface 765*a* may substantially be parallel to an extending line extending in a tangential direction of the first cyclone part 110.

The lower end 765*b* of the frame guide 765 may be located below the contact end 771*a* of the cleaning part 770. The lower end 766*a* of the lower extension wall 766 may be located below the lower end 765*a* of the frame guide 765.

Hereinafter, the frame 760 will be described in detail.

Figure 11:
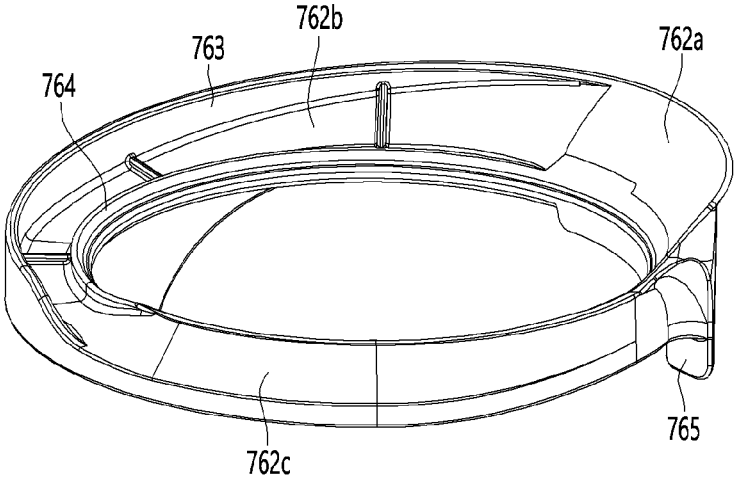
FIG. 11 is a perspective view of a frame of FIG. 9, viewed from a direction "A".
Figure 12:
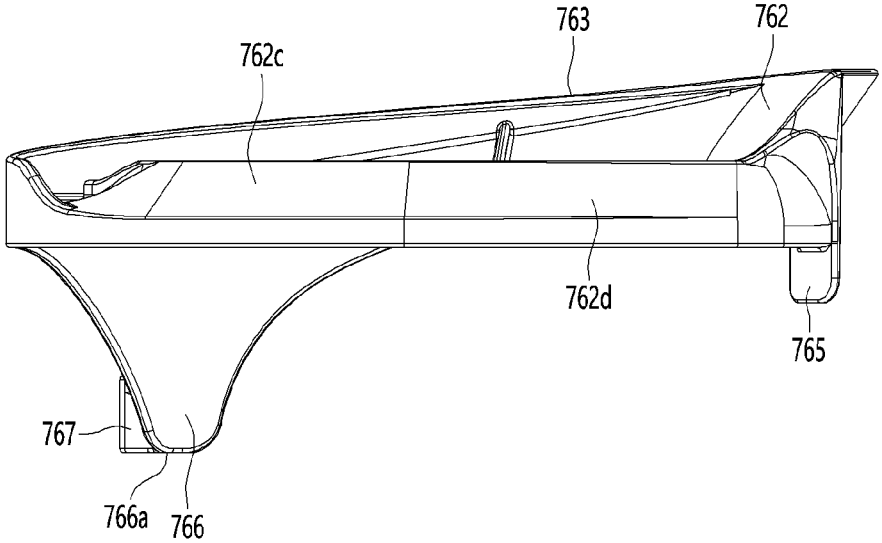
FIG. 12 is a side view of the frame of FIG. 9, viewed from a direction "B".
Figure 13:
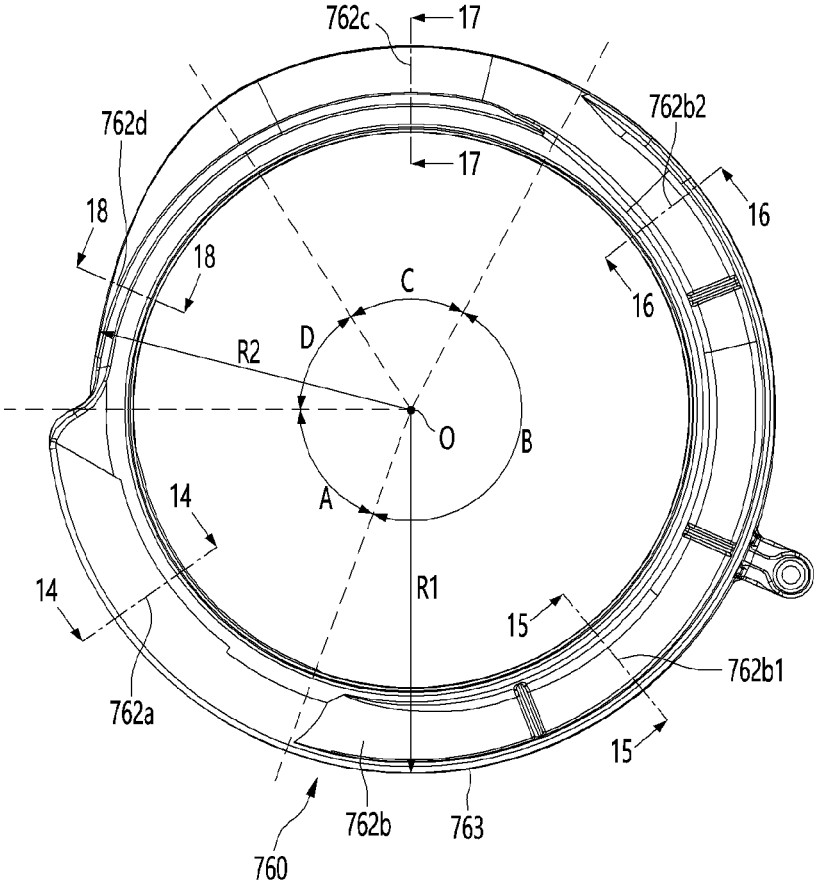
FIG. 13 is a plan view of a frame according to an embodiment of the present disclosure.
Figure 14:
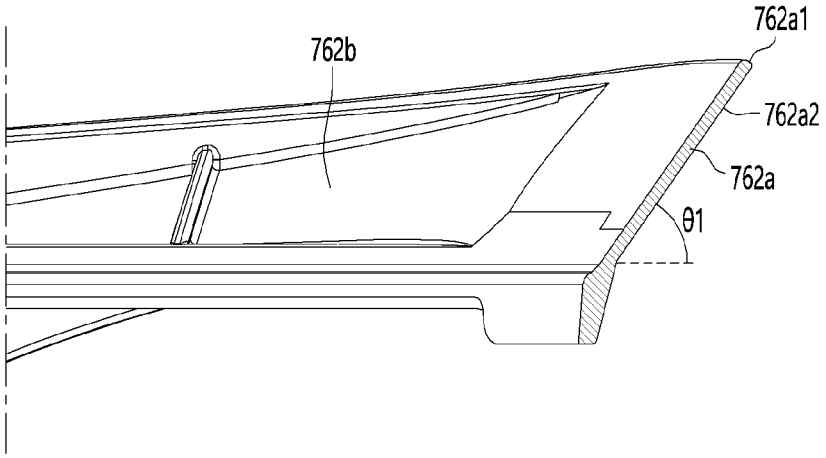
FIG. 14 is a cross-sectional view taken along line 14-14 of FIG. 13.
Figure 15:
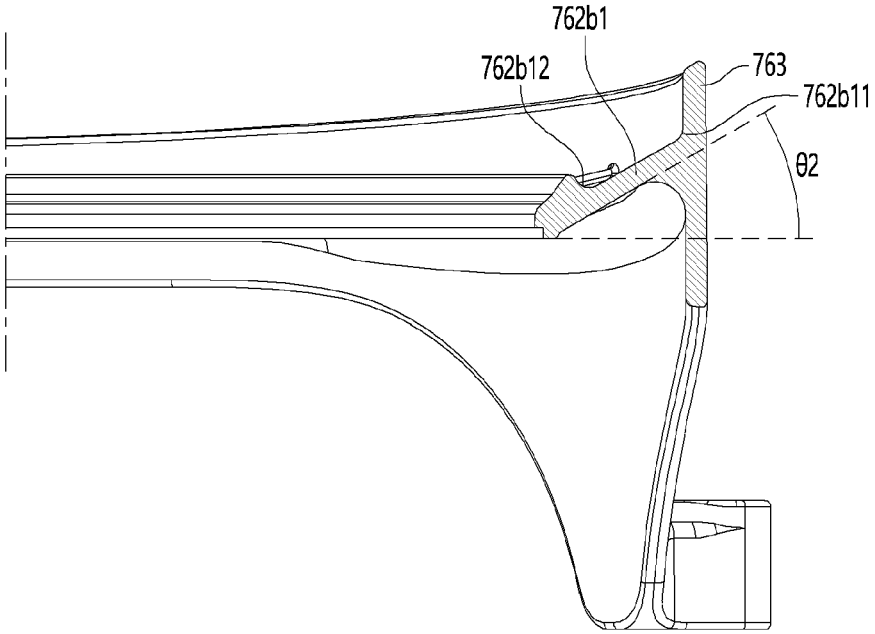
FIG. 15 is a cross-sectional view taken along line 15-15 of FIG. 13.
Figure 16:
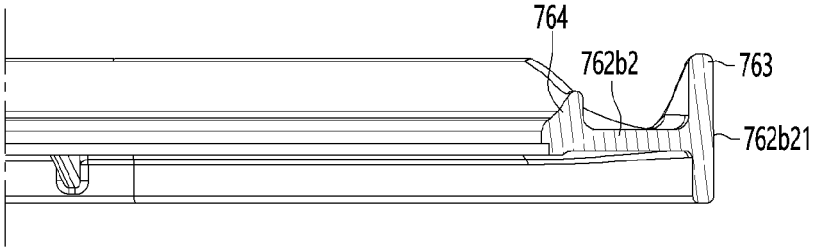
FIG. 16 is a cross-sectional view taken along 16-16 of FIG. 13.
Figure 17:
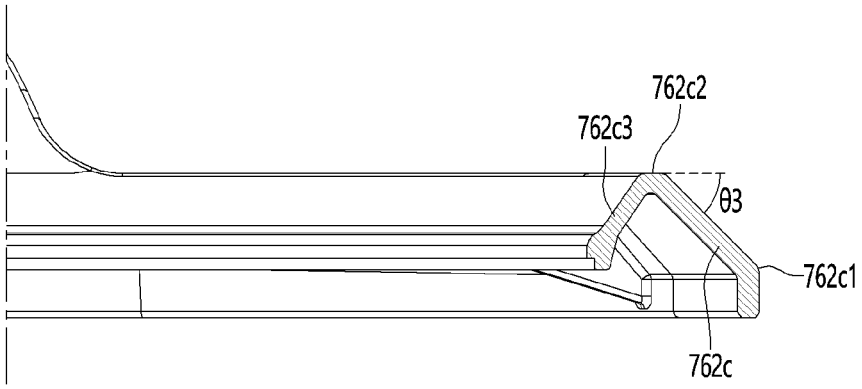
FIG. 17 is a cross-sectional view taken along line 17-17 of FIG. 13.
Figure 18:
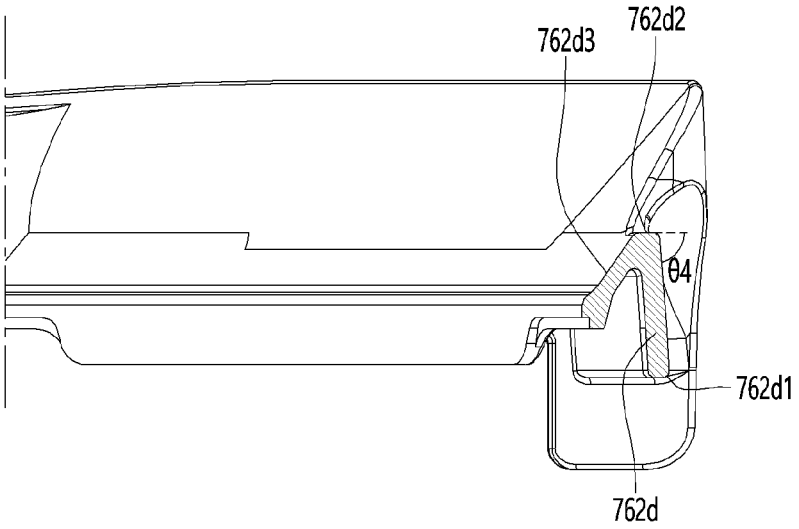
FIG. 18 is a cross-sectional view taken along line 18-18 of FIG. 13.

FIG. 11 is a perspective view of the frame of FIG. 9, viewed from a direction "A". FIG. 12 is a side view of the frame of FIG. 9, viewed from a direction "B". FIG. 13 is a plan view of a frame according to an embodiment of the present disclosure. FIG. 14 is a cross-sectional view taken along line 14-14 of FIG. 13. FIG. 15 is a cross-sectional view taken along line 15-15 of FIG. 13. FIG. 16 is a cross-sectional view taken along line 16-16 of FIG. 13. FIG. 17 is a cross-sectional view taken along line 17-17 of FIG. 13. FIG. 18 is a cross-sectional view taken along line 18-18 of FIG. 13.

Referring to FIGS. 11 to 18, the frame body 761 may include a first body 762*a*. The first body 762*a* may surround an outer surface of the air guide 170.

An outer end 762*a*1 (or upper end) of the first body 762*a* based on a radial direction in the frame bodies 761 may be located at the highest portion of the first body 762*a*. The radial direction may be a direction perpendicular to the extending direction of the axis A1 of the cyclone flow.

The first body 762*a* may be in contact with an outer surface of the air guide 170, which will be described later.

Referring to FIG. 14, the first body 762*a* may be inclined by a first angle θ1 with respect to a horizontal plane. When the first body 762*a* is inclined by the first angle θ1, a contact area between the first body 762*a* and dust stored in the first dust storage 120 may increase in a state where the movable part 750 has moved to the dust compression position, while air and dust suctioned through the suction part 5 may be guided in a downward direction.

When the contact area between the first body 762*a* and the dust stored in the first dust storage 120 increases, a compression area of the dust may increase to compress the dust stored in the first dust storage 120 overall, thereby improving dust compression performance by the movable part 750.

The first body 762*a* may be inclined outward from the lower side to the upper side. Since the air suctioned through the suction part 5 may flow toward the outer surface of the first body 762*a*, when the first body 762*a* is inclined outward from the lower side to the upper side, a lower flow of the suctioned dust may become relatively smooth.

An inclination angle of at least a portion of the first body 762*a* with respect to the horizontal plane in the circumferential direction of the frame body 761 may be constant. A portion in which the inclination angle is constant in the first body 762*a* may be in contact with the air guide 170.

In addition, the air suctioned through the suction part 5 may smoothly flow in the circumferential direction along the portion where the inclination angle is constant in the first body 762*a*. A radius R1 of the outer end 762*a*1 of the first body 762*a* may be constant in the circumferential direction. Referring to FIG. 13, the first body 762*a* may extend by an angle A section based on a center O of the frame body 761.

The frame body 761 may further include a second body 762*b* extending in the circumferential direction from the first body 762*a*. The second body 762*b* may be inclined at an angle that is less than the first angle 81 with respect to the horizontal plane. Thus, as the second body 762*b* is inclined at the second angle 82, a space may be formed between the air guide 170 and the second body 762*b* (See FIG. 23). The space may act as an air flow path P.

For example, the inclination angle of the second body 762*b* with respect to the horizontal plane may be reduced in a direction away from the first body 762*a*.

A height of the outer end of the second body 762*b* based on the radial direction may be lower in a direction away from the first body 762*a* than in a direction near the first body 762*a*. Therefore, the second body 762*b* may guide the air and dust to flow in a downward spiral direction, while providing a flow path allowing air and dust to flow therethrough.

Referring to FIG. 15, a first portion 762*b*1 spaced apart by a first distance from the first body 762*a* in the second body 762*b* may be inclined by a second angle θ2 with respect to the horizontal plane. The second angle θ2 is smaller than the first angle θ1.

The outer end 762*b*11 (or upper end) of the first portion 762*b*1 may be located lower than the outer end 762*a*1 (or upper end) of the first body 762*a*.

If the outer end 762*b*11 of the first portion 762*b*1 is located lower than the outer end 762*a*1 (or upper end) of the first body 762*a*, a vertical gap between the second body 762*b* and the air guide 170 may be increased.

When the inclination angle of the first portion 762*b*1 is less than the inclination angle of the first body 762*a*, the first portion 762*b*1 may be spaced apart from the air guide 170.

Referring to FIG. 16, a second portion 762*b*2 spaced apart by the second distance from the first body 762*a* in the second body 762*b* may be substantially parallel to the horizontal plane. That is, the inclination angle of the second portion 762*b*2 may be 0 (zero) or greater than 0. That is, a portion of the second body 762*b* may be parallel to the horizontal plane. Here, the second distance is greater than the first distance.

The outer end 762*b*21 of the second portion 762*b*2 may be located lower than the outer end 762*b*11 of the first portion 762*b*1.

A radius of the outer end of the second body 762*b* may be substantially equal to a radius R1 of the upper end 762*a*1 of the first body 762*a*.

Referring to FIG. 13, the second body 762*b* may extend by an angle B section based on the center O of the frame body 761. The angle B is greater than the angle A. Therefore, in this embodiment, a circumferential length of the second body 762*b* is longer than a circumferential length of the first body 762*a*.

The frame body 761 may further include a third body 762*c* extending from the second body 762*b*.

Referring to FIG. 17, at a point of the third body 762*c*, the third body 762*c* may be inclined at a third angle θ3 with respect to the horizontal plane.

The third body 762*c* may be inclined outward from the upper side to the lower side. For example, the third body 762*c* may include an inner end 762*c*2 and an outer end 792*c*1 based on the radial direction, and the outer end 792*c*1 is located lower than the inner end 762*c*2. Therefore, the inner end 762*c*2 may be referred to as an upper end and the outer end 792*c*1 may be referred to as a lower end.

As an example, referring to FIG. 13, the third body 762*c* may extend by an angle C section based on the center O of the frame body 761. The angle C is smaller than the angle B.

The radius of the outer end 762*c*1 (or lower end) of the third body 762*c* may be substantially equal to the radius R1 of the upper end 762*a*1 of the first body 762*a*.

The outer end 762*c*1 of the third body 762*c* may be located lower than the outer end of the second body 762*b*. The inner end 762*c*2 (or upper end) of the third body 762*c* may be located lower than the outer end 762*b*11 of the first portion 762*b*1 of the second body 762*b*. The inner end 762*c*2 of the third body 762*c* may be located above the outer end 762*b*21 of the second portion 762*b*2 of the second body 762*b*. That is, the inner end 762*c*2 of the third body 762*c* may be located above one point of the second body 762*b* and lower than another point.

The frame body 761 may further include a first contact body 762*c*3 inclined downward toward the center from the inner end 762*c*2 of the third body 762*c*.

The first contact body 762*c*3 may be in contact with the air guide 170.

The frame body 761 may further include a fourth body 762*d* extending from the third body 762*c*.

Referring to FIG. 18, at a point of the fourth body 762*d*, the fourth body 762*d* may be inclined at a fourth angle 84 with respect to the horizontal plane. The fourth angle θ4 is greater than the third angle θ3.

The fourth body 762*d* may be inclined outward from the upper side to the lower side. For example, the fourth body 762*d* may include an inner end 762*d*2 and an outer end 792*d*1, with the outer end 792*d*1 being located lower than the inner end 762*d*2.

The fourth body 762*d* may extend by an angle D section based on the center O of the frame body 761. The angle D is smaller than the angle C.

Referring to FIG. 13, for example, a radius R2 of the outer end 762*d*1 of the fourth body 762*d* is smaller than a radius R1 of the upper end 762*a*1 of the first body 762*a*. The radius R1 of the outer end 762*d*1 of the fourth body 762*d* is smaller than a radius of the outer end 762*c*1 of the third body 762*c*.

The radius R2 of the outer end 762*d*1 of the fourth body 762*d* may be reduced in a direction away from the third body 762*c*.

The frame body 761 may further include a second contact body 762*d*3 inclined in a downward direction toward the center at the inner end 762*c*2 of the fourth body 762*d*. The second contact body 762*d*3 may be in contact with the air guide 170.

The operation of the frame body 761 according to the shape of the frame body 761 as described above will be described.

At the standby position of the movable part 750, the first body 762*a* may face the suction opening 12*a*.

Since the first body 762*a* is in contact with the air guide 170, the air introduced through the suction opening 12*a* may flow in the space between the outer surface 762*a*2 and the inner circumferential surface of the first cyclone part 110 may flow.

Since the inclination angle of the second body 762*b* is less than the inclination angle of the first body 762*a*, the inner surface 762*b*12 of the second body 762*b* may be spaced apart from the air guide 170.

Accordingly, a portion of the air flowing through the space between the outer surface 762*a*2 of the first body 762*a* and the inner circumferential surface of the first cyclone part 110 may flow the space between the air guide 170 and the inner surface 762*b*12 of the second body 762*b*. Therefore, the inner surface 762*b*12 of the second body 762*b* serves as a guide surface.

Since the inclination angle of the second body 726*b* decreases in a direction away from the first body 762*a*, a height of the space between the air guide 170 and the inner surface 762*b*12 of the second body may increase in a direction away from the first body 762*a*.

The frame body 761 may further include a first extension wall 763 (or outer extension wall) to restrict air from flowing outward in the radial direction of the second body 762*b* in the process in which air flows along the inner surface 762*b*12 of the second body 762*b*.

The first extension wall 763 may extend upward from an outer end of the second body 762*b*. Accordingly, air flowing along the inner surface 762*b*12 of the second body 762*b* may be restricted to flow outward in the radial direction of the second body 762*b* by the first extension wall 763. The first extension wall 763 may define an air flow path P to be described later. That is, the first extension wall 763 may act as an outer wall of the air flow path P. The first extension wall 763 may guide air in the air flow path P to spirally flow.

The frame body 761 may further include a second extension wall 764 (or inner extension wall). The second extension wall 764 may extend in a circumferential direction about the axis of the cyclone flow, and the first extension wall 763 may be spaced outward from the second extension wall 764 in the radial direction.

The second extension wall 764 may extend upward from an inner end of the second body 762*b*. The second body 762*b* may connect the first extension wall 763 and the second extension wall 764. The second extension wall 764 may act as an inner wall of the air flow path P.

A height of the second extension wall 764 in the first portion 762*b*1 may be lower than a height of the first extension wall 763.

The third body 762*c* functions to guide the air flowing along the inner surface 762*b*12 of the second body 762*b* to fall downward. The fourth body 762*d* serves to guide air that has not fallen downward from the third body 762*c* to finally fall downward.

Figure 19:
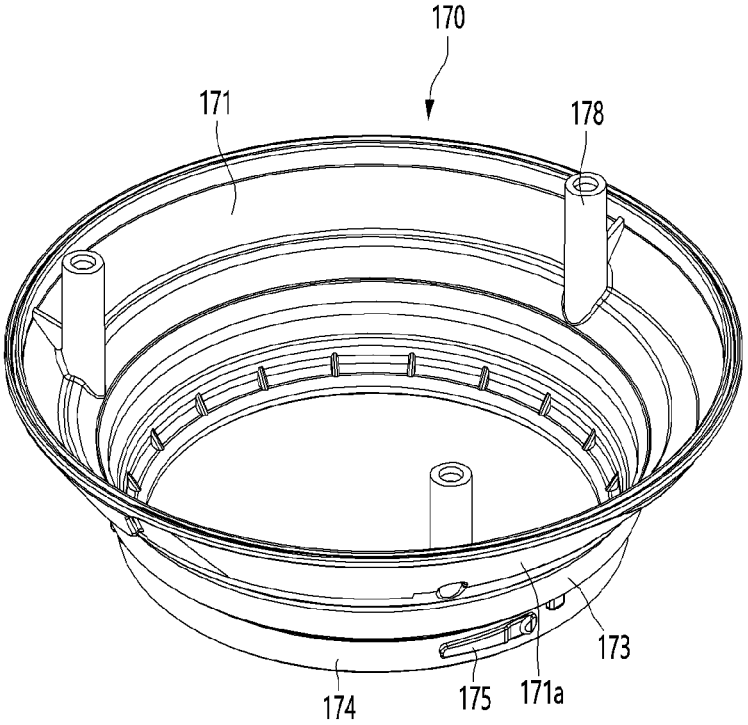
FIG. 19 is a perspective view of an air guide according to an embodiment of the present disclosure.
Figure 20:
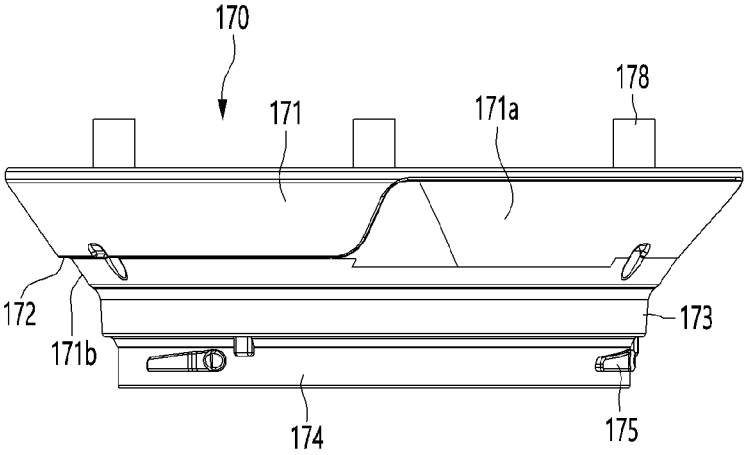
FIG. 20 is a side view of the air guide of FIG. 19.

FIG. 19 is a perspective view of an air guide according to an embodiment of the present disclosure. FIG. 20 is a side view of the air guide of FIG. 19.

Referring to FIGS. 19 and 20, the air guide 170 may include a first guide wall 171. The air guide 170 may be fixed in position in the main body 2.

An inner circumferential surface of the first guide wall 171 may form a flow path guiding air discharged from the second cyclone part 140.

The first guide wall 171 may be formed in a ring-like shape, for example and a diameter thereof may increase from the lower side to the upper side. Therefore, the air discharged from the second cyclone part 140 may rise smoothly.

The first guide wall 171 may include a first seating portion 171*a* allowing a portion of the frame body 761 to be seated or accommodated thereon. The first seating portion 171*a* may be formed as an outer circumferential surface of the first guide wall 171 is recessed in a direction toward the center. The first body 762*a* of the frame body 761 may be seated or accommodated on the first seating portion 171*a*.

The first guide wall 171 may further include a second seating portion 171*b*. The second seating portion 171*b* may be formed as the outer circumferential surface of the guide wall 171 is recessed in a direction toward the center. The first contact body 762*c*3 and the second contact body 762*d*3 of the frame body 761 may be seated and brought into contact with the second seating portion 171*b*.

A step surface 172 is formed on the first guide wall 171 due to the second seating portion 171*b*. The second extension wall 764 may be in contact with the step surface 172.

The inclination angle of the first guide wall 171 with respect to the horizontal plane may be equal to the first angle θ1 of the first body 762*a*, so that the first guide wall 171 and the first body 762*a* may be in contact with each other.

In addition, the inclination angles of the first contact body 762*c*3 and the second contact body 762*d*3 with respect to the horizontal plane may be equal to the inclination angle of the first guide wall 171. Therefore, the first body 762*a* may be in contact with the first seating portion 171*a*.

In addition, the first contact body 762*c*3 and the second contact body 762*d*3 may be in contact with the second seating portion 171*b*.

The air guide 170 may further include a second guide wall 173 extending from a lower side of the first guide wall 171. The second guide wall 173 may be formed in a cylindrical shape or may be formed in a truncated cone shape with a diameter decreasing downward.

The air guide 170 may further include a coupling body 174 extending to a lower side of the second guide wall 173. The second cyclone part 140 may be coupled to the coupling body 174.

A coupling projection 175 may be formed on the outer circumferential surface of the coupling body 174. The coupling projection 175 may be accommodated in a projection recess (not shown) of the second cyclone part 140.

The air guide 170 may further include a fastening boss 178 (e.g., fastener) extending upward from the inner circumferential surface of the first guide wall 171. The air guide 170 may be fastened with a component in the body 2 by the fastening boss 178.

Figure 21:
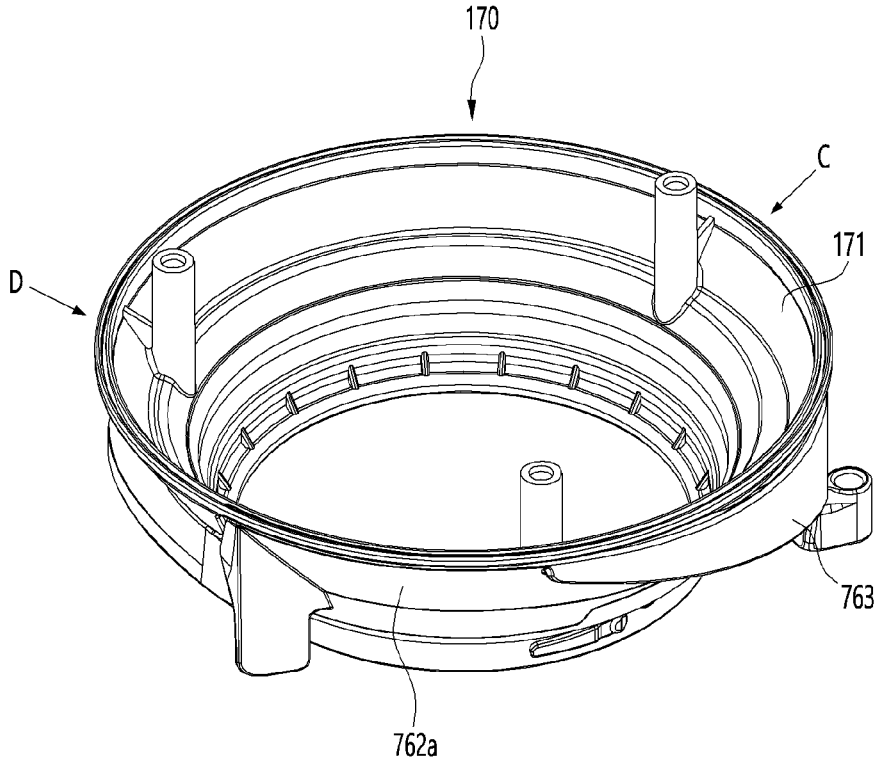
FIG. 21 is a view showing an arrangement relationship of a movable part and an air guide at a standby position of the movable part.
Figure 22:
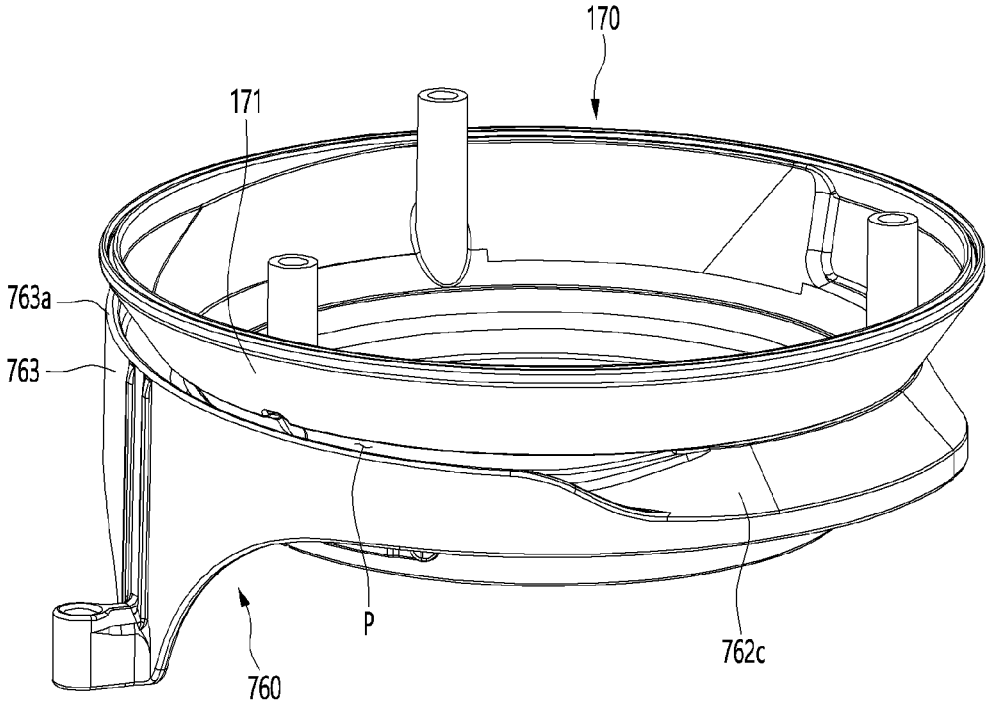
FIG. 22 is a perspective view of the air guide and the movable part of FIG. 21, viewed in a direction "C".
Figure 23:
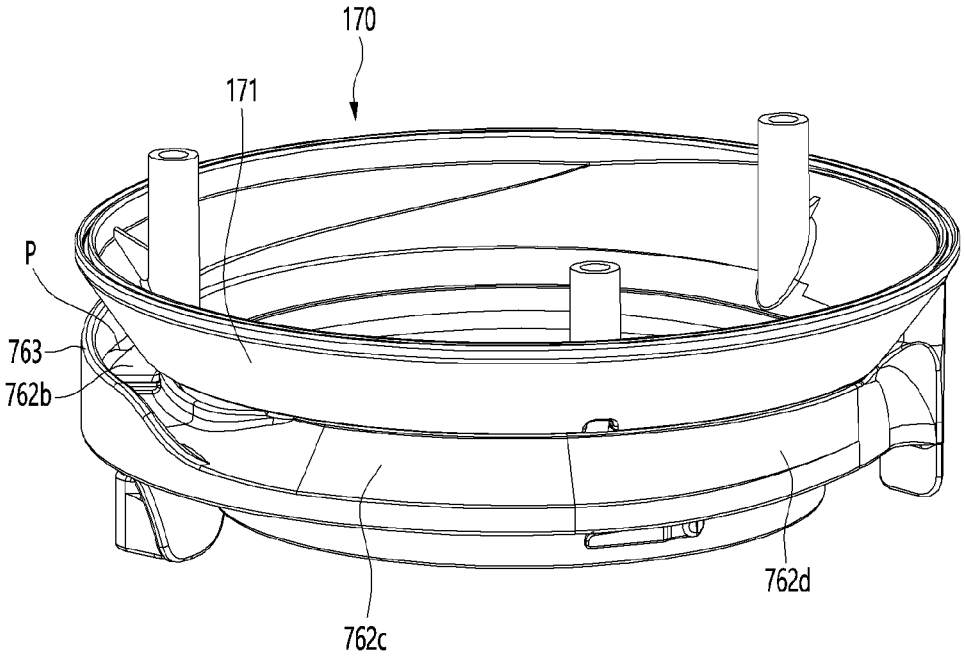
FIG. 23 is a perspective view of the air guide and movable part of FIG. 21, viewed in a direction "D".
Figure 24:
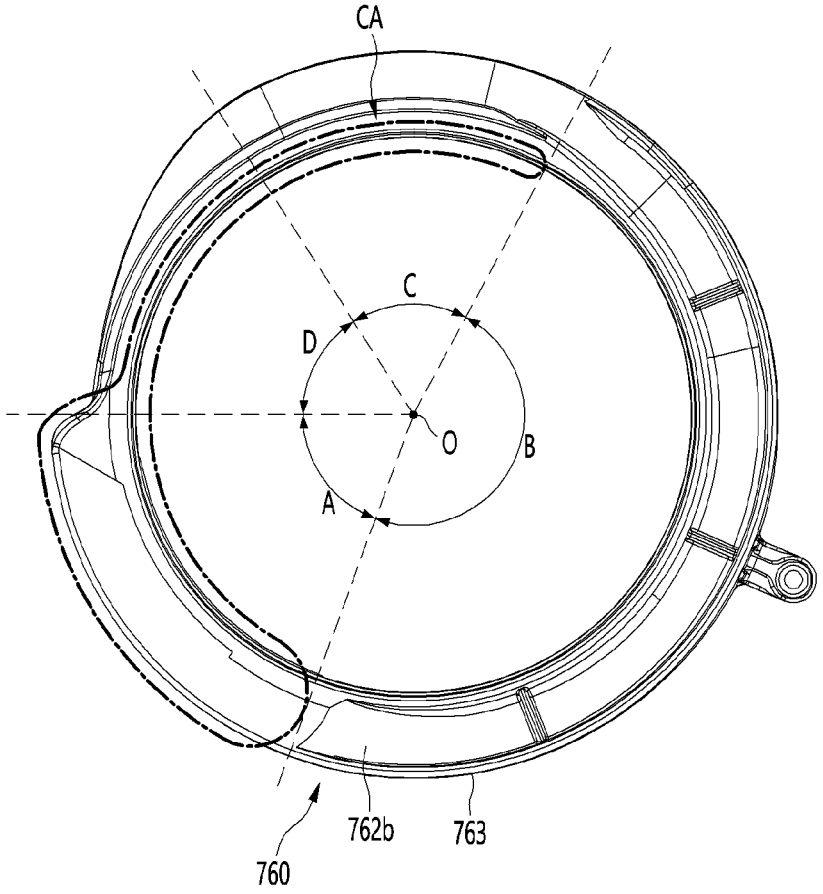
FIG. 24 is a view showing a contact area in contact with an air guide in a frame body.

FIG. 21 is a view showing an arrangement relation of a movable part and an air guide at a standby position of the movable part. FIG. 22 is a perspective view of the air guide and the movable part of FIG. 21, viewed in a direction "C". FIG. 23 is a perspective view of the air guide and the movable part of FIG. 21, viewed in a direction "D". FIG. 24 is a view showing a contact area CA in contact with the air guide in the frame body.

Referring to FIG. 21, at the standby position of the movable part 750, the first body 762*a* may be in contact with the first guide wall 171.

Referring to FIGS. 22 and 23, at the standby position of the movable part 750, the second body 762*b* may be spaced apart from the first guide wall 171. Accordingly, an air flow path P is formed between the second body 762*b* and the first guide wall 171.

As described above, since the inclination angle of the second body 762*b* with respect to the horizontal plane is reduced in a direction away from the first body 762*a*, a height of the air flow path P may be gradually increased.

The height of the upper end 763*a* of the first extension wall 763 may be lower in a direction away from the first body 762*a* than towards the first body 762*a*. Accordingly, a distance between the upper end 763*a* of the first extension wall 763 and the first guide wall 171 may be gradually increased.

The contact area CA in contact with the air guide 170 in the frame 760 is illustrated in FIG. 24, and an area other than the contact area CA may form an air flow path in relation to the air guide 170.

Figure 25:
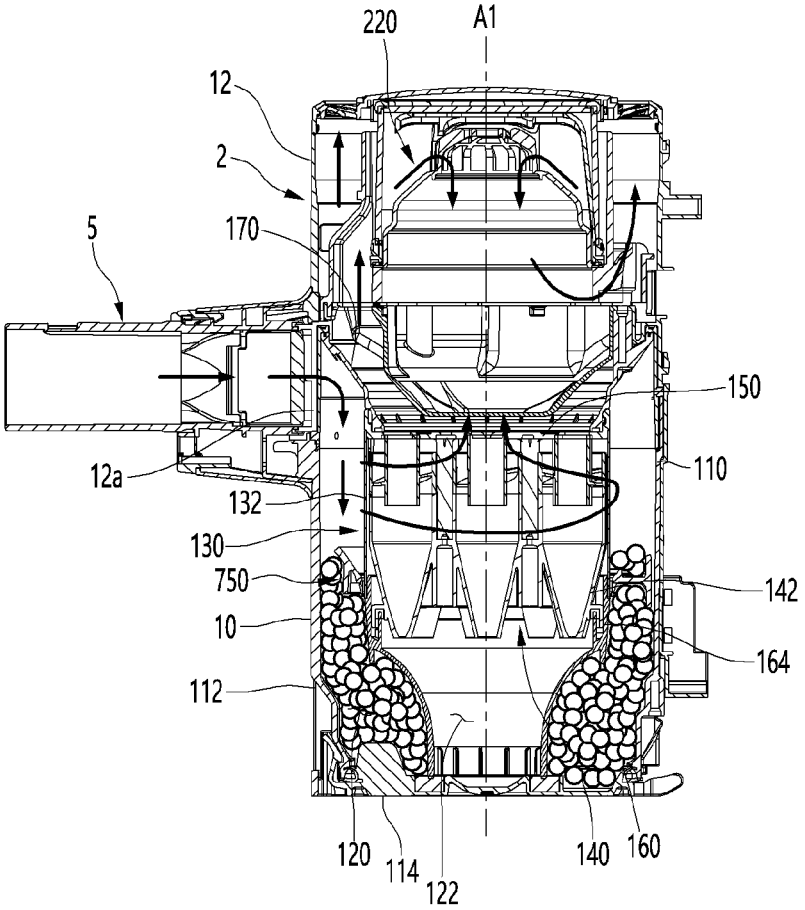
FIG. 25 is a view showing a state where air and dust flow in a state where the movable part moves to a dust compression position in FIG. 5.
Figure 26:
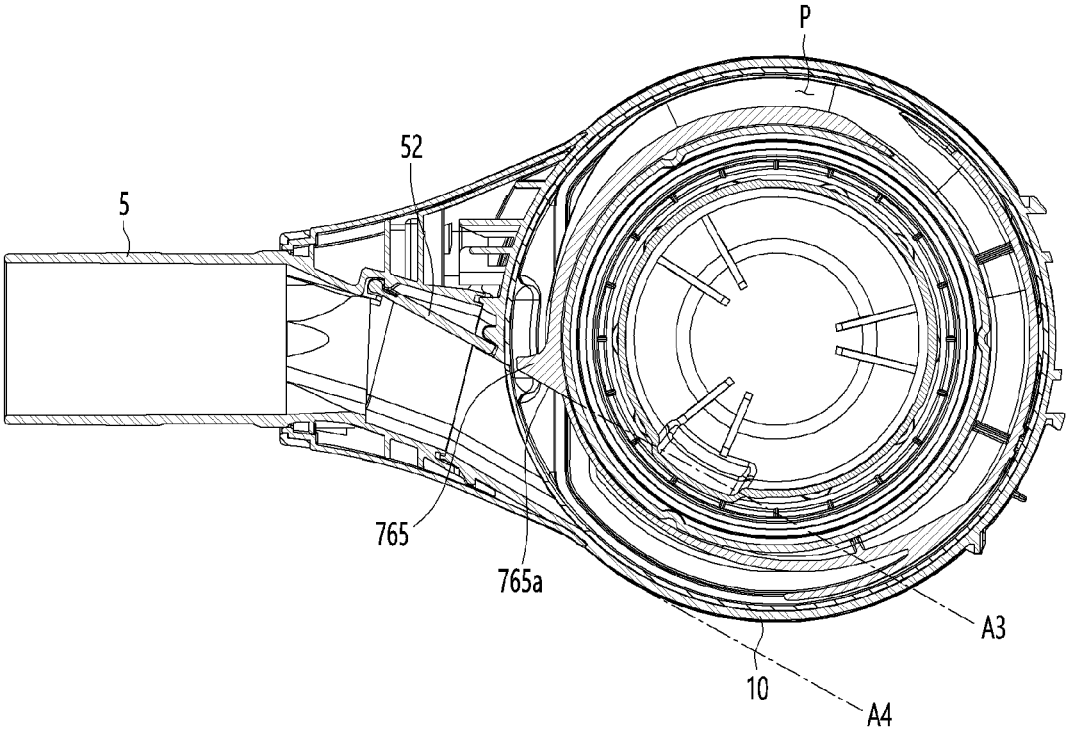
FIG. 26 is a cross-sectional view taken along line 26-26 of FIG. 5.
Figure 27:
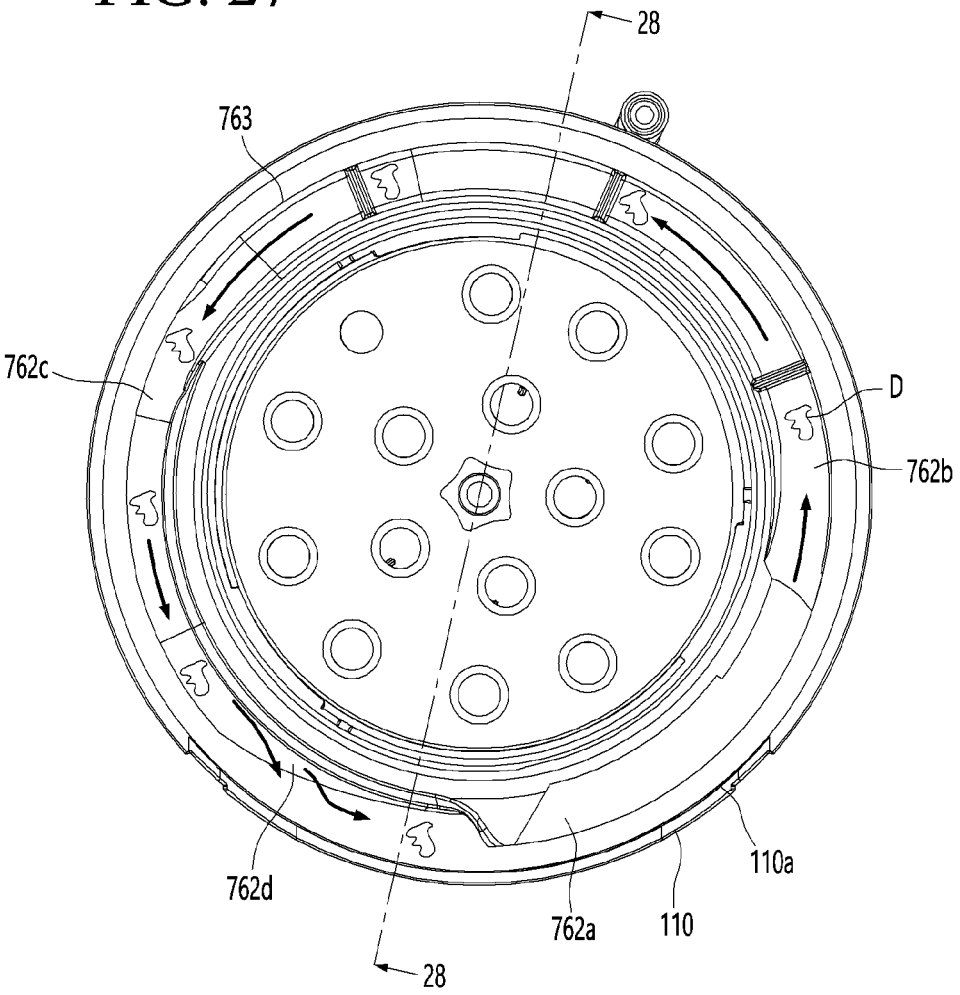
FIG. 27 is a cross-sectional view taken along line 27-27 of FIG. 5
Figure 28:
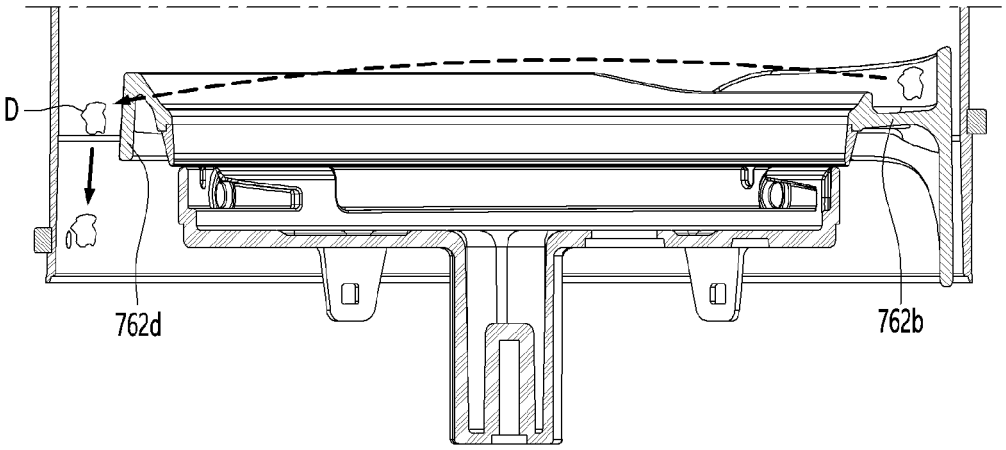
FIG. 28 is a cross-sectional view taken along line 28-28 of FIG. 27.

FIG. 25 is a view showing a state of air and dust flowing in a state where the movable part moves to the dust compression position in FIG. 5. FIG. 26 is a cross-sectional view taken along lines 26-26 of FIG. 5. FIG. 27 is a cross-sectional view taken along line 27-27 of FIG. 5. FIG. 28 is a cross-sectional view taken along line 28-28 of FIG. 27.

Referring to FIGS. 25 to 28, the suction part 5 includes a flow guide 52 for guiding a flow of air and dust, and the frame guide 765 may extend in the same direction as the extending direction of the flow guide 52 or in a direction parallel thereto.

For example, an extending line A4 extending in a tangential direction of the first housing 10 may be parallel to an extending line A3 of the frame guide 765.

Therefore, the air introduced into the first cyclone part 110 through the suction opening 12*a* may change in a flow direction by the frame guide 765 and flow along the inner circumferential surface 110*a*.

At the standby position, the second body 762*b* may be spaced apart from the first guide wall 171 and the upper end 763*a* of the first extension wall 763 may be spaced apart from the first guide wall 171, a portion of the air flowing along the inner circumferential surface 110*a* of the first cyclone part 110 may flow to the air flow path P.

That is, while a portion of the air introduced through the suction opening 12*a* flows along the air flow path P and another portion thereof may spirally flow along the inner circumferential surface 110*a* of the first cyclone part 110, the air may be separated from dust.

In this disclosure, the air flow path P above the frame body 761 may be referred to as an upper flow path and a flow path located below the frame body 761 may be referred to as a lower flow path.

In addition, a space between the frame body 761 and the inner circumferential surface of the housing (e.g., the inner circumferential surface 110*a* of the first cyclone part 110) may be referred to as a communication flow path connecting the upper flow path and the lower flow path. Air and dust on the upper flow path may move to the lower flow path through the communication flow path.

The first body 761*a* may be disposed to face the suction opening 12*a*. Therefore, it is possible to prevent air and dust suctioned through the suction opening 12*a* from directly flowing into the air flow path P.

The air introduced into the air flow path P may flow along the second body 762*b*. Air flowing along the second body 762*b* may be prevented from flowing in the radial direction of the second body 762*b* by the first guide rib 763.

Since the second extension wall 764 may be in contact with the step surface 172 of the air guide 170, air is prevented from flowing between the second body 762*b* and the second extension wall 172.

Referring to FIG. 27, at the standby position of the movable part 750, the frame body 761 may be spaced apart from the inner circumferential surface 110*a* of the first cyclone part 110, for example, of the inner surface of the housings 10 and 12.

Therefore, in the process in which the movable part 750 moves in an up and down direction, the movable part 750 may be prevented from rubbing with the inner surfaces of the housings 10 and 12 and air or dust may fall downward through a space between the movable part 750 and the inner surfaces of the housings 10 and 12.

The movable part 750 may be operated by operating the operating part 710 by the user, and thus the user may operate the operating part 710 while the cleaner 1 is operating (suction motor 220 is operating).

Referring to FIG. 25, during the operation of the cleaner 1, the movable part 750 may move in a downward direction by the operation of the operating part 710.

A case where the movable part 750 has moved to a position lower than the lower end of the suction opening 12*a* will be described.

Since the movable part 750 is spaced apart from the inner circumferential surface 110*a* of the first cyclone part 110 at a position where the movable part 750 has moved in a downward direction, air and dust suctioned through the suction opening 12*a* may move more smoothly downward through a space between the movable part 750 and the inner circumferential surface 110*a* of the first cyclone part 110.

At the position where the movable part 750 has moved downward, dust D may accumulate in the air flow path P formed by the movable part 750.

The movable part 750 may rise in a state where dust D accumulates in the air flow path P of the movable part 750. When the movable part 750 rises in the state where dust D accumulates in the air flow path P of the movable part 750, the movable part 750 may not be located at a regular position, and thus the movable part 750 may act as a flow resistance of air flowing through the suction opening 12*a*.

For example, if large amount of dust D is located in the air flow path P of the movable part 750 and the state where the dust D is not removed from the air flow path P is maintained, the dust may come into contact with the first guide wall 171, and in this case, the first body 762*a* may be spaced apart from the first guide wall 171.

Here, air suctioned through the suction opening 12*a* may flow between the first body 762*a* and the first guide wall 171.

If the air suctioned through the suction opening 12*a* flows between the first body 762*a* and the first guide wall 171, air presses the first body 762*a* in a downward direction.

Here, even if the user does not operate the operating part 710, the movable part 750 may move in a downward direction, and thus, dust separation performance may be deteriorated by air flow resistance.

In addition, when the first body 762*a* is not in contact with the first guide wall 171, the movable part 750 is located in an inclined state without maintaining level overall, and thus a downward movement of the movable part 750 is not smooth when the user operates the operating part 710.

However, according to the present disclosure, even if the movable part 750 rises in a state where the dust D accumulates in the air flow path P of the movable part 750, a portion of air suctioned through the suction opening 12*a* may flow through the air flow path P.

When air flows through the air flow path P, the dust D may be moved in the air flow path P by air.

In the present embodiment, since the vertical width of the air flow path P gradually increases, the dust D in the air flow path P may be more easily moved together with the air.

In addition, referring to FIGS. 27 and 28, the dust D flowing along the second body 762*b* may fall downward along the third body 762*c* due to the increase in the inclination angle of the third body 762*c*. Even if the dust D does not fall downward along the third body 762*c*, the dust may fall downward on the fourth body 762*d* side.

In the case of this embodiment, since the radius at the outer end 762*d*1 of the fourth body 762*d* is the minimum at the frame body 761, a gap between the fourth body 762*d* and the inner circumferential surface 110*a* of the first cyclone part 110 is maximized.

In addition, since the inclination angle of the fourth body 762*d* is greater than the inclination angle of the third body 762*c*, dust may more easily fall downward along the fourth body 762*d*.

Therefore, according to the present embodiment, in the cleaning process, even if the movable part rises with dust accumulating on the upper part of the movable part, air flowing along the air flow path of the movable part may move the dust and the moved dust may fall downward, and thus the movable part may be stably located at the regular position.

In the above embodiment, it is described that the frame body 761 includes the first body to the fourth body 762*a*, 762*b*, 762*c*, and 762*d*, but alternatively, the frame body 761 may include the first body to the third body 762*a*, 762*b*, and 762*c*.

In this case, the radius of the third body 762*c* may be less than the radius of the first body 762*a* and the dust D on the air flow path P may fall downward through the space between the third body 762*c* and the inner circumferential surface 110*a* of the first cyclone part 110.

In the present disclosure, the second body 762*b* forming the air flow path P in the frame body 761 may be referred to as a flow path body. The flow path body may include a first portion inclined by a first angle with respect to the horizontal plane and a second portion extending from the first portion and inclined by a second angle smaller than the first angle with respect to the horizontal plane.

Further, in the present disclosure, the third body 762*c* may be referred to as a third portion and the first body 762*a* may be referred to as a fourth portion to correspond to the first portion and the second portion of the second body 762*b*.

The third body 762*c* or the third body 762*c* and the fourth body 762*d* guides the dust in the air flow path P to fall downward, and thus the third body 762*c* or the third body 762*c* and the fourth body 762*d* may be referred to as guide bodies.

When the frame body includes only the third body 762*c*, a width of at least a portion of the third body may be reduced in the circumferential direction. In this case, for example, a distance between a point of the third body 762*c* and the inner circumferential surface 110*a* of the first cyclone part 110 is greater than a distance between the second body 762*b* and the inner circumferential surface 110*a* of the first cyclone part 110.

It will be apparent to those skilled in the art that various modifications and variations may be made in the present disclosure without departing from the spirit or scope of the disclosures. Thus, it is intended that the present disclosure covers the modifications and variations of this disclosure provided they come within the scope of the appended claims and their equivalents.

What is claimed is:

1. A cleaner comprising:

a housing including a suction opening, a cyclone part configured to separate dust, and a dust bin configured to store dust separated at the cyclone part; and a frame configured to be movable between a first position and a second position in the housing and disposed such that at least a portion thereof faces the suction opening at the first position, wherein the frame includes a frame body disposed to surround an axis of a cyclone flow of the cyclone part at the first position, the frame body includes an inner extension wall extending in a circumferential direction based on the axis of the cyclone flow of the cyclone part, an outer extension wall spaced apart from the inner extension wall in a radial direction, and a flow path body configured to connect the inner extension wall and the outer extension wall, and the inner extension wall, the outer extension wall, and the flow path body forms an air flow path through which a portion of the air suctioned through the suction opening flows.

2. The cleaner of claim 1, wherein the flow path body includes a first portion inclined by a first angle with respect to the horizontal plane and a second portion extending from the first portion and inclined by a second angle smaller than the first angle with respect to the horizontal plane.

3. The cleaner of claim 2, wherein an outer end of the second portion is located lower than an outer end of the first portion.

4. The cleaner of claim 2, wherein a portion of the flow path body is parallel to the horizontal plane.

5. The cleaner of claim 4, wherein a portion of the second portion the second portion is parallel to the horizontal plane.

6. The cleaner of claim 2, wherein a height of the outer extension wall at the second portion is lower than a height of the outer extension wall at the first portion.

7. The cleaner of claim 2, wherein the height of the outer extension wall at the first portion is higher than the height of the inner extension wall at the first portion.

8. The cleaner of claim 2, wherein the frame body further comprises an additional body extending from the flow path body to the opposite side of the first portion with respect to the second portion, the first portion is inclined in a direction toward the axis of the cyclone flow from an upper side to a lower side and the additional body is inclined in a direction away from the axis of the cyclone flow from the upper side to the lower side.

9. The cleaner of claim 8, wherein a radius of a portion of the additional body based on the center of the frame body is smaller than a radius of the first portion.

10. The cleaner of claim 2, wherein the frame body further includes an additional body extending from the flow path body to the opposite side of the second portion based on the first portion, and an inclination angle of the additional body with respect to the horizontal plane is greater than an inclination angle of the first portion.

11. The cleaner of claim 10, wherein a circumferential length of the flow path body is longer than a circumferential length of the additional body.

12. The cleaner of claim 2, wherein a height of the air flow path at the second portion is higher than a height of the air flow path at the first portion.

13. The cleaner of claim 1, wherein the frame body further includes an additional body facing the suction opening at the first position and having an inclination angle larger than that of the flow path body with respect to a horizontal plane.

14. The cleaner of claim 1, wherein the second position is a position lower than the first position.

15. The cleaner of claim 1, further comprising an air guide configured to guide air discharged from the cyclone part, and wherein the frame body is arranged to surround the air guide at the first position.

16. The cleaner of claim 15, wherein the cyclone part comprises a first cyclone part and a second cyclone part configured to dust from air received from the first cyclone part, and the guide air is configured to guide air discharged from the second cyclone part.

* * * * *